US008066147B2

(12) United States Patent
Meers et al.

(10) Patent No.: US 8,066,147 B2
(45) Date of Patent: Nov. 29, 2011

(54) CRATE WITH COLLAPSIBLE WALL

(75) Inventors: Ryan C. Meers, Los Angeles, CA (US); Justin M. Smyers, Newport Beach, CA (US); Roger S. Hsu, Torrance, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 514 days.

(21) Appl. No.: 12/200,286

(22) Filed: Aug. 28, 2008

(65) Prior Publication Data

US 2009/0057320 A1 Mar. 5, 2009

Related U.S. Application Data

(60) Provisional application No. 60/968,507, filed on Aug. 28, 2007, provisional application No. 60/975,497, filed on Sep. 26, 2007.

(51) Int. Cl.
*B65D 8/04* (2006.01)
*B65D 8/14* (2006.01)
*B65D 25/54* (2006.01)

(52) U.S. Cl. ..... 220/682; 220/4.28; 220/4.31; 220/6; 220/7; 220/660; 220/666; 206/600; 206/774; 292/57

(58) Field of Classification Search ..... 220/1.5, 220/4.28, 4.31, 6, 7, 660, 666, 682; 206/600, 206/774; 292/2, 57
See application file for complete search history.

(56) References Cited

U.S. PATENT DOCUMENTS 2,780,381 A * 2/1957 Coit, Jr. ..... 220/6
3,372,829 A * 3/1968 Averill ..... 220/6
3,835,792 A 9/1974 Wharton
3,981,410 A 9/1976 Schurch
4,406,380 A 9/1983 Paige
4,674,647 A 6/1987 Gyenge et al.
4,765,480 A 8/1988 Malmanger
5,016,772 A 5/1991 Wilk
5,161,709 A 11/1992 Oestreich, Jr.
6,015,056 A 1/2000 Overholt et al.
6,098,827 A 8/2000 Overholt et al.
6,209,742 B1 4/2001 Overholt et al.

(Continued)

FOREIGN PATENT DOCUMENTS

CH 456 438 7/1968

(Continued)

OTHER PUBLICATIONS

European Search Report for EP Application No. 08252850.6, Dec. 16, 2008.

(Continued)

*Primary Examiner* — Anthony Stashick
*Assistant Examiner* — Madison L Wright
(74) *Attorney, Agent, or Firm* — Carlson, Gaskey & Olds

(57) ABSTRACT

A crate, such as for transporting egg cartons or other items, includes a base, opposed side walls and a rear wall extending upward from the base. A front wall opposite the rear wall is selectably moveable between a closed position and a retracted, open position. In the retracted position, access to the interior of the crate is provided. In one embodiment, the front wall includes a plurality of pivotably connected sections, such that the front wall can be retracted to provide access to the interior. A latch selectively prevents movement of the front wall to the retracted position.

14 Claims, 26 Drawing Sheets

U.S. PATENT DOCUMENTS

| | | | |
|---|---|---|---|
| 6,290,081 | B1 | 9/2001 | Merey |
| 6,305,566 | B1 | 10/2001 | Pigott |
| 6,601,724 | B1 | 8/2003 | Koefelda et al. |
| 6,918,502 | B1 | 7/2005 | Overholt et al. |
| 7,011,225 | B2 | 3/2006 | Oster et al. |
| 7,264,122 | B2 | 9/2007 | Koefelda et al. |
| 2002/0070215 | A1 | 6/2002 | Walsh et al. |
| 2003/0000950 | A1 | 1/2003 | Murakami et al. |
| 2004/0200833 | A1 | 10/2004 | Dubois et al. |
| 2006/0231555 | A1 | 10/2006 | Smyers et al. |
| 2006/0260976 | A1 | 11/2006 | Apps |

FOREIGN PATENT DOCUMENTS

| | | | |
|---|---|---|---|
| DE | 92 03 114 | | 5/1992 |
| DE | 93 05 904 | | 8/1993 |
| DE | 43 19 099 | A1 | 12/1994 |
| EP | 0690003 | | 1/1996 |
| EP | 0 785 142 | | 7/1997 |
| EP | 1 225 131 | | 7/2002 |
| FR | 1227059 | | 6/1959 |
| FR | 2 810 020 | A1 | 12/2001 |
| GB | 2 357 078 | | 6/2001 |
| GB | 2 360 762 | | 10/2001 |
| GB | 2 431 922 | | 5/2007 |
| GB | 2 449 502 | | 11/2008 |
| JP | 2007-76655 | | 3/2007 |
| WO | 95/21773 | | 8/1995 |
| WO | 98/40199 | | 9/1998 |
| WO | 2006/010311 | | 2/2006 |

OTHER PUBLICATIONS

European Search Report for European Application No. 07254779.7, Apr. 11, 2008.

* cited by examiner

CRATE WITH COLLAPSIBLE WALL

This application claims priority to U.S. Provisional Patent Application Nos. 60/968,507 and 60/975,497, filed Aug. 28, 2007 and Sep. 26, 2007, respectively.

BACKGROUND OF THE INVENTION

The present invention relates generally to containers and more particularly to a crate that is particularly useful for transporting egg cartons or other items to a store.

Currently, egg cartons are shipped to stores in metal crates. The crates must be unloaded onto shelves for the customers to select and purchase. This requires labor for handling the egg cartons in the store. The metal crates are expensive and are damaged easily. They are also subject to rust and are not recyclable. They are also not easily repairable.

SUMMARY OF THE INVENTION

The present invention provides a crate or container, such as for transporting egg cartons or other items. The crate includes a base, opposed side walls and a rear wall extending upward from the base. A front wall opposite the rear wall is selectably moveable between a closed position and a retracted, open position. In the retracted position, access to the interior of the crate is provided. A latch selectively prevents the front wall from being retracted.

In use, egg cartons (or other items) would be shipped to a store in the crate with the front wall closed. At the store, the front wall would be retracted to provide access to the egg cartons in the interior of the crate by customers or by store workers. The empty crate can then be returned to be reused in shipping additional egg cartons.

These and other features of the present invention can be best understood from the following specification and drawings, the following of which is a brief description.

BRIEF DESCRIPTION OF THE DRAWINGS

FIG. 3D is a rear perspective view of the middle section of FIG. 3C.

DETAILED DESCRIPTION OF THE PREFERRED EMBODIMENT

Figure 1:
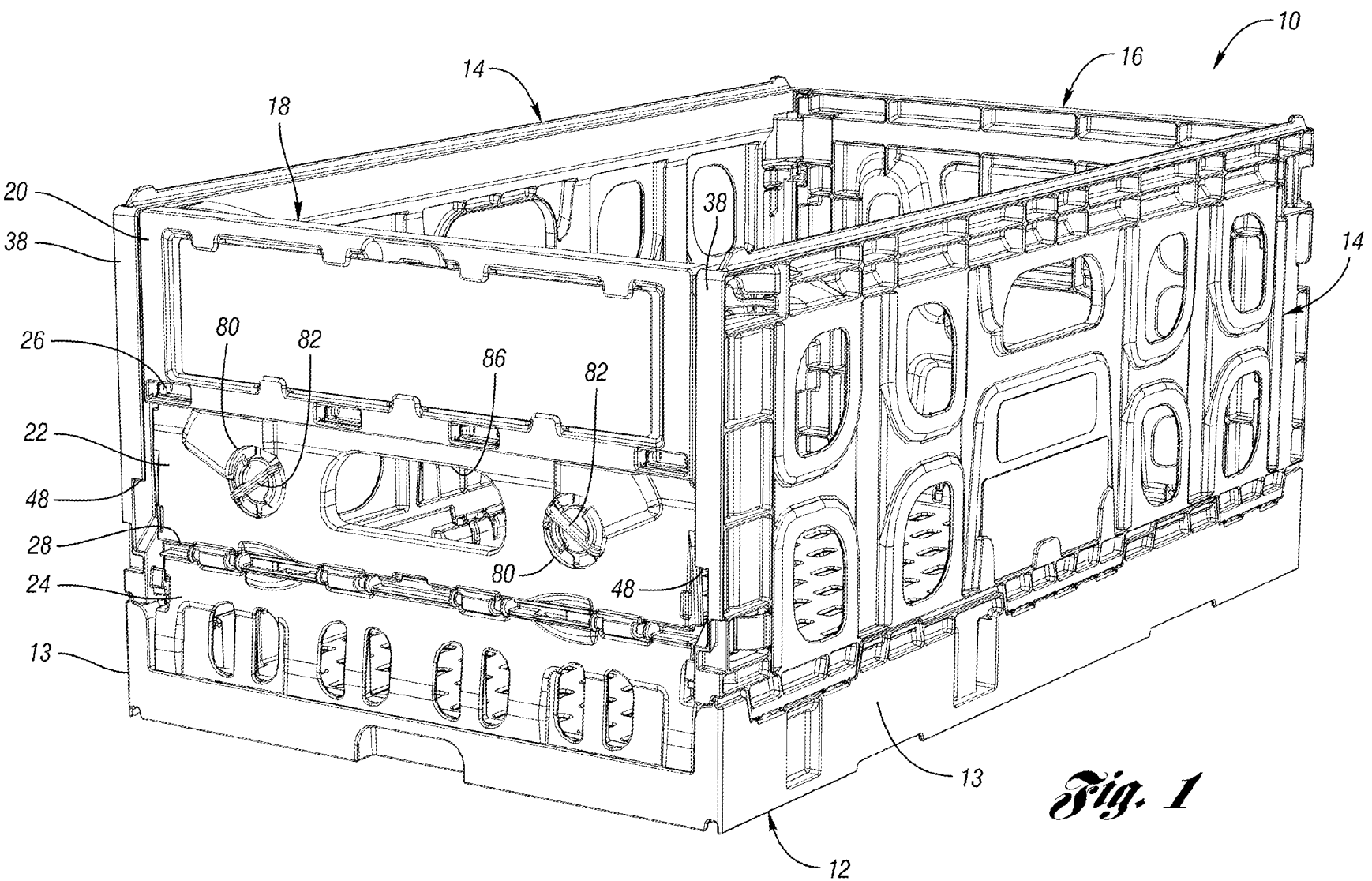
FIG. 1 is a front perspective view of a crate according to a first embodiment of the present invention.

A crate 10, such as for transporting egg cartons or other items, according to a first embodiment of the present invention is shown in FIG. 1. The crate 10 includes a base 12 having integrally molded upstanding portions 13 to which are hingably connected side walls 14. A rear wall 16 is also hingably connected to the base 12 and latched to the side walls 14.

The front wall 18 includes an upper section 20, a middle section 22 and a lower section 24. The upper section 20 is connected to the middle section 22 by a hinge 26. The middle section 22 is connected to the lower section 24 by a hinge 28. Rotatable latches 80 selectively prevent pivoting of the upper section 20, middle section 22 and lower section 24 relative to one another. The latches 80 include protruding handle portions 82. An opening through the middle section 22 forms a handle 86 for lifting and carrying the crate 10.

Figure 2:
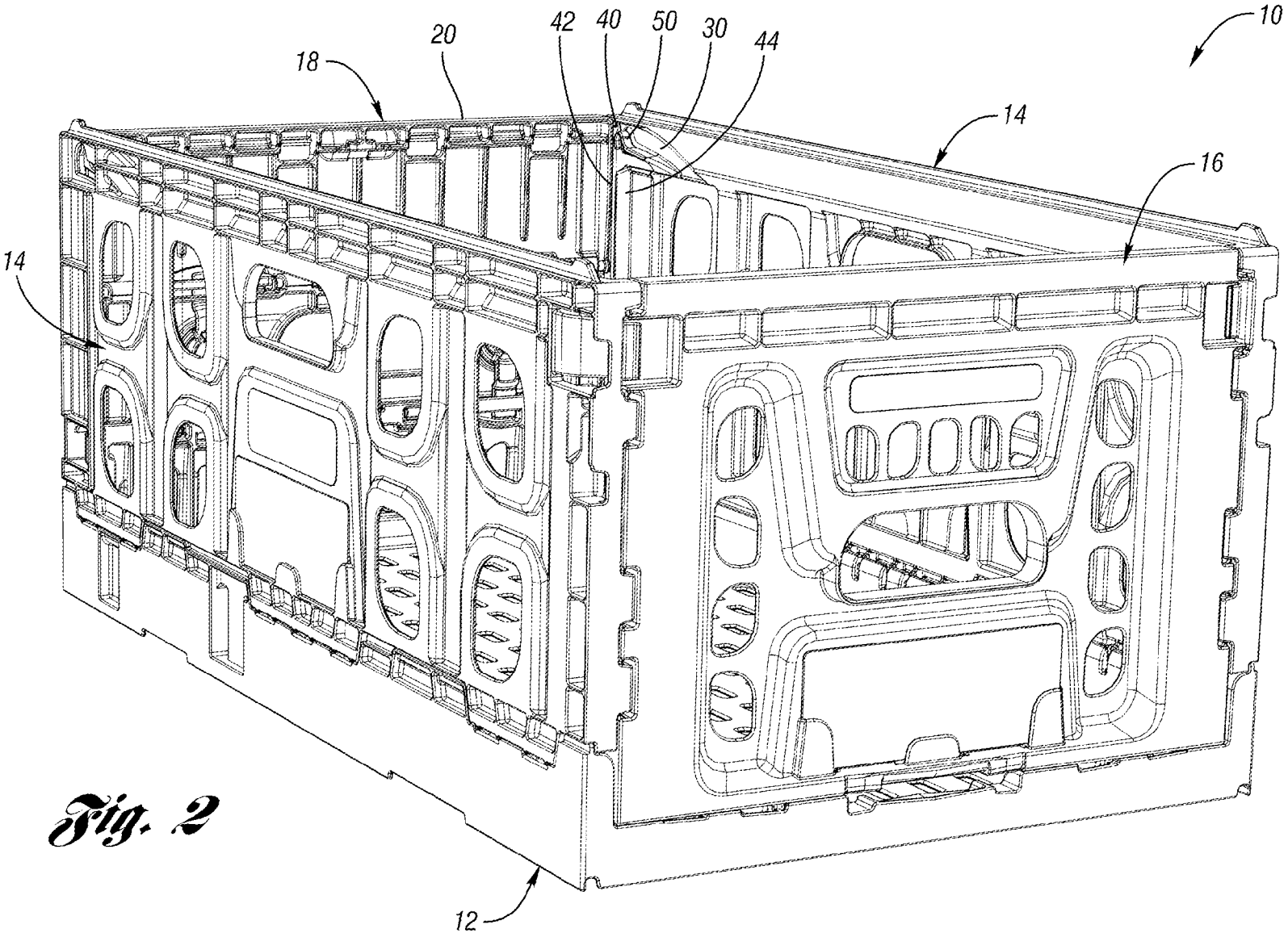
FIG. 2 is a rear perspective view of the crate of FIG. 1.

The side walls 14 each include a small outer flange portion 38 having a lower opening 48. The outer flange portion 38 is spaced outwardly of an inner flange portion 44 to define a channel 42 therebetween, as can be seen in FIG. 2. Lateral protrusions 40 near an upper edge of the upper section 20 of the front wall 18 are trapped between the outer flange portion 38 and a flexible latch 50 protruding from the side wall 14 when the front wall 18 is in the upright, closed position as shown. To collapse the front wall 18, the flexible latch 50 can be deflected downward by force inward on the front wall 18.

The interior of the side walls 14 each include a curved channel 30 extending from an upper portion of the upper section 20 down to the base 12 in an arcuate path. The curved channels 30 accommodate the lateral protrusions 40 when the front wall 18 is moved toward the collapsed position onto the base 12.

Figure 3:
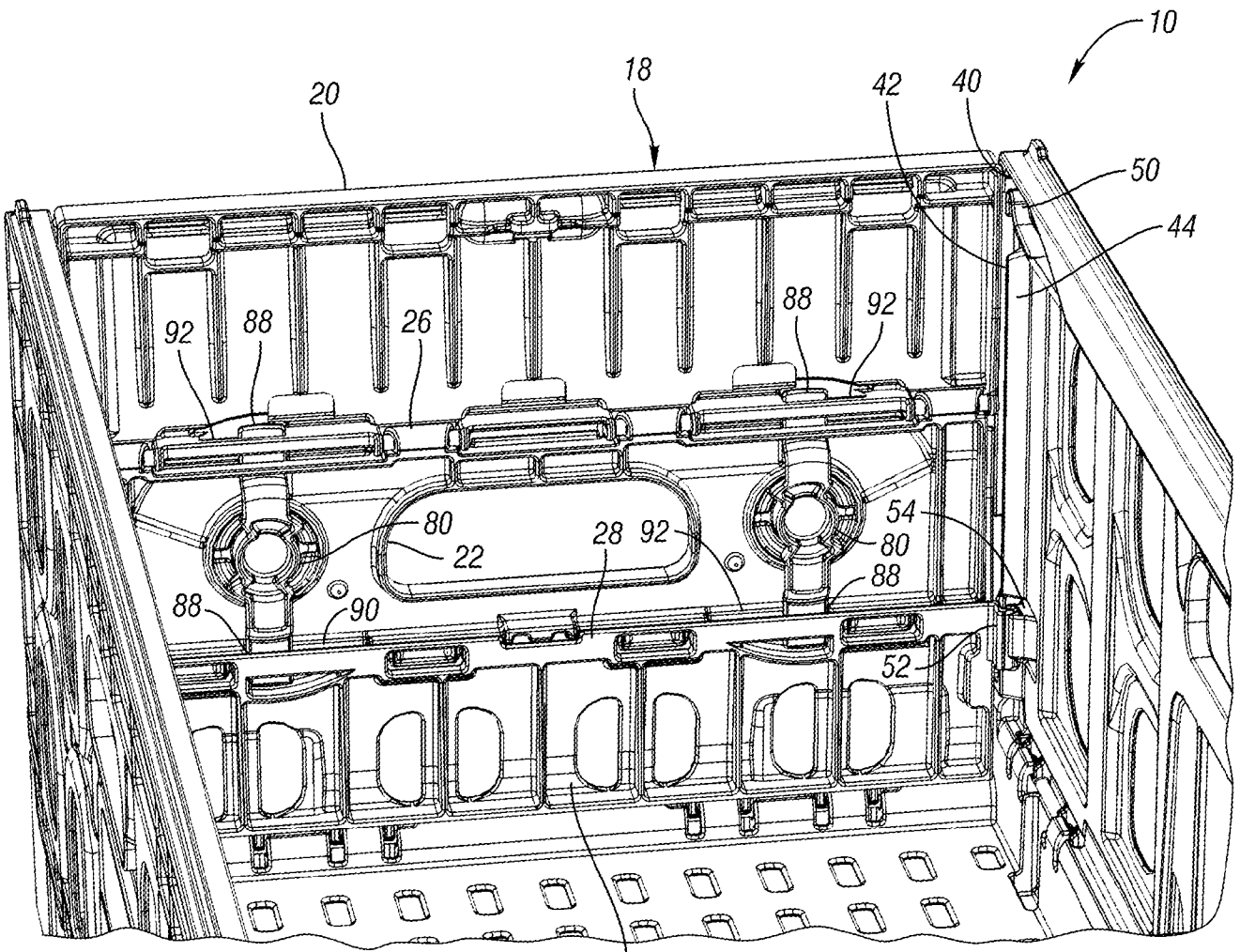
FIG. 3 is an interior perspective view of the front of the crate of FIG. 1.

FIG. 3 is an interior perspective view of the front of the crate 10 of FIG. 1. The latches 80 each include a pair of elongated fingers 88 extending therefrom. One finger 88 of each latch 80 is received in a slot 90 in the lower section 24. One finger 88 of each latch 80 is received in a slot 92 in the upper section 22. The fingers 88 prevent the upper section 20, middle section 22 and lower section 24 from pivoting relative to one another on hinges 26, 28.

Figure 3B:
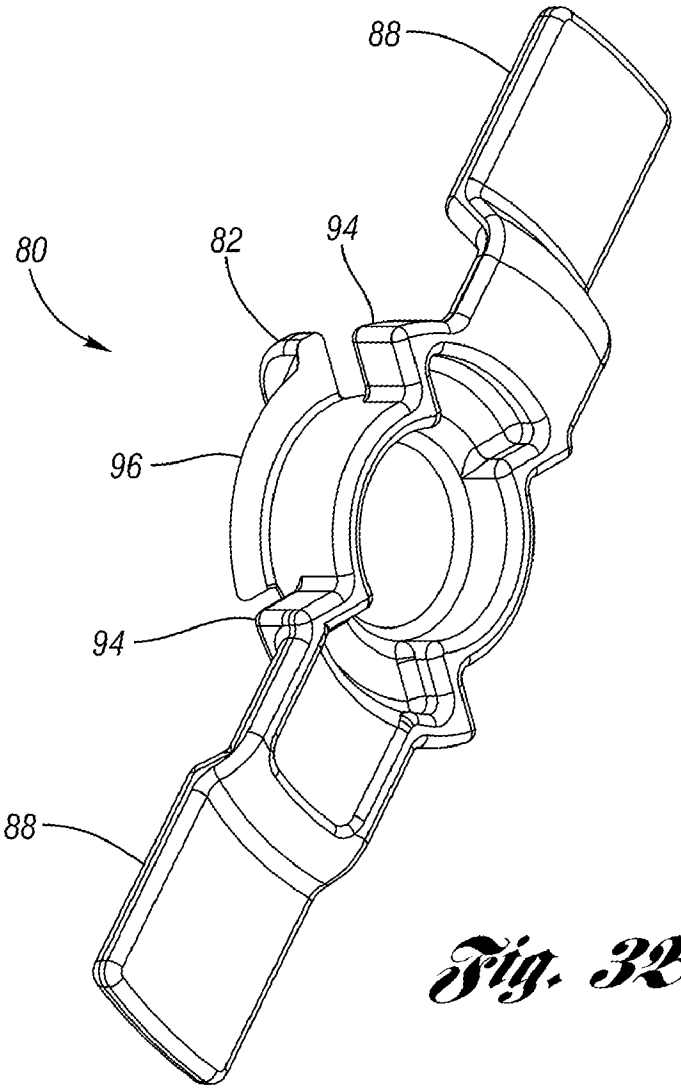
FIG. 3B is a rear perspective view of the latch of FIG. 3A.
Figure 3A:
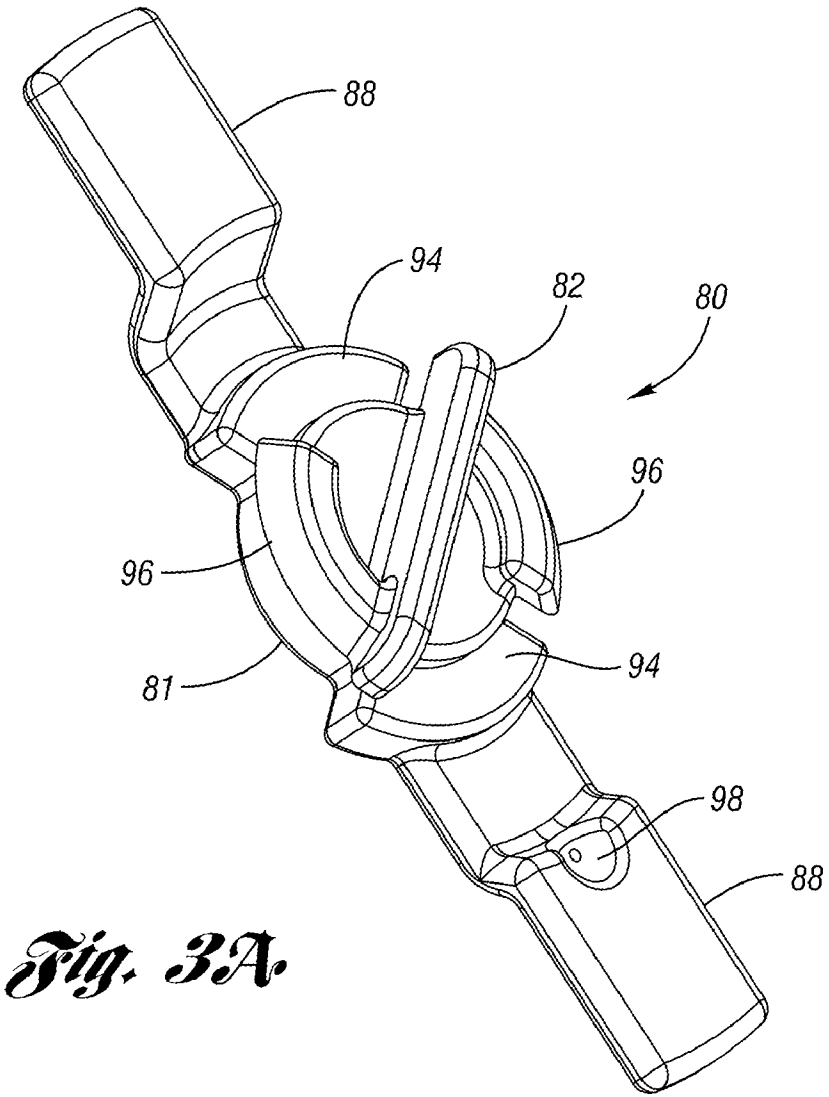
FIG. 3A is a front perspective view of one of the latches of the front wall.

FIGS. 3A and 3B are front and rear perspective views, respectively, of one of the latches 80 of the front wall 18. The latch 80 includes a generally circular body portion 81 from which the handle portion 82 protrudes forwardly. Axially and circumferentially offset rear ears 94 and front ears 96 extend radially from the body portion 81. The fingers 88 extend radially outward, then axially forward, then radially outward from the rear ears 94. At least one of the fingers 88 includes a recess 98 for retaining the latch 80 in a desired rotational position, as will be explained below.

Figure 3C:
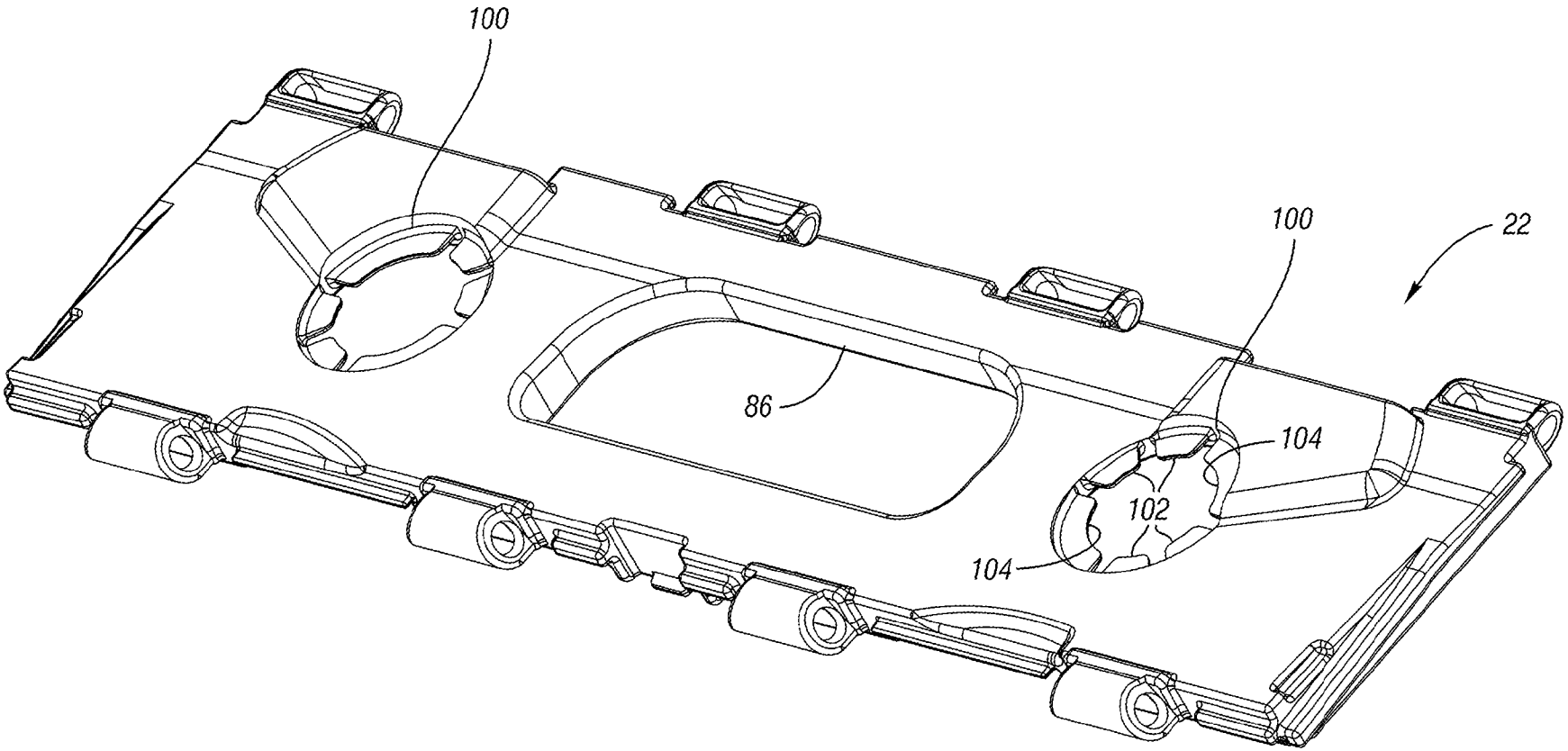
FIG. 3C is a front perspective view of the middle section of the front wall of the crate of FIG. 1.
Figure 3A:
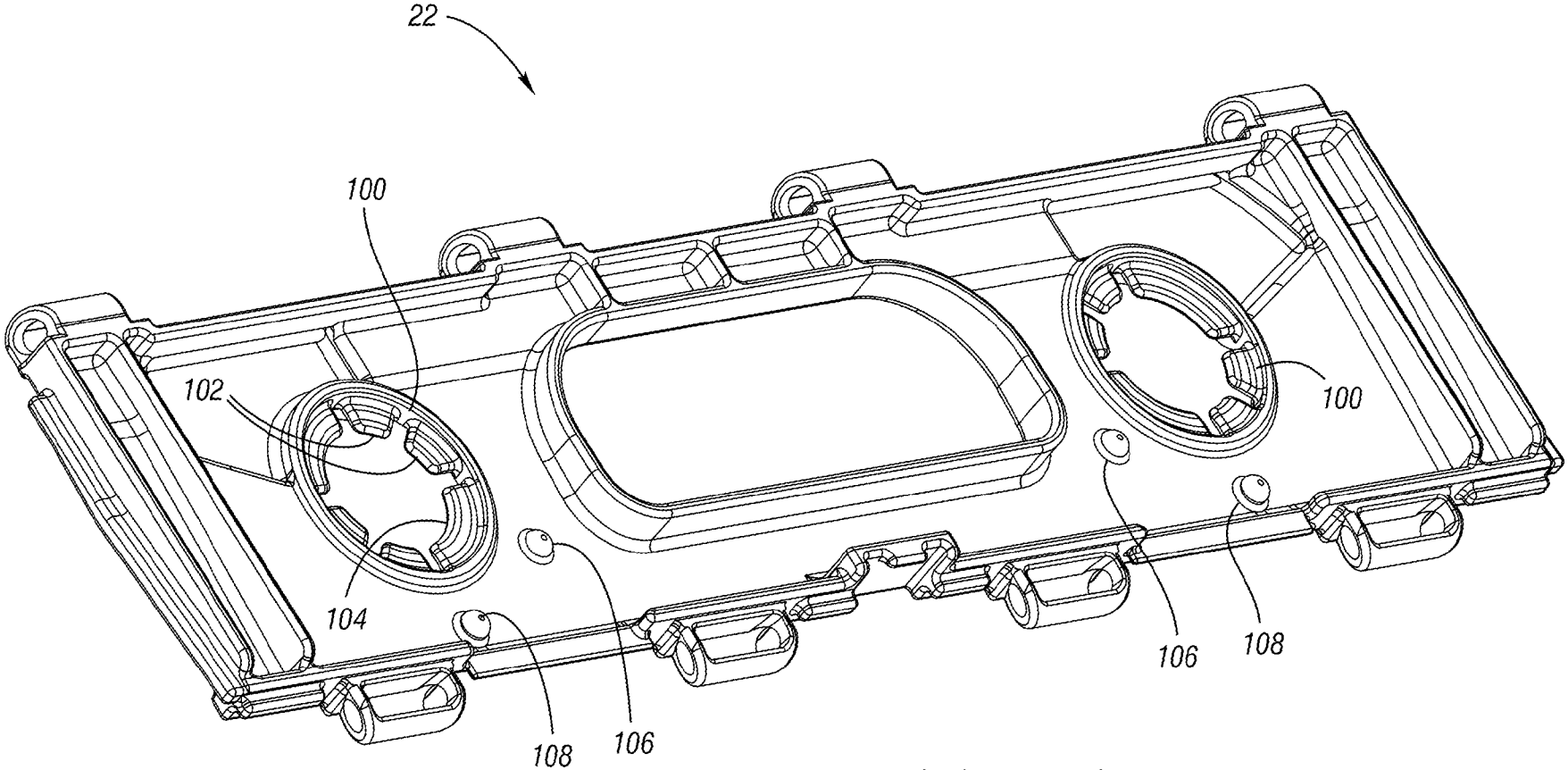

FIGS. 3C and 3D are front and rear perspective views of the middle section 22 of the front wall 18. The middle section 22 includes an opening 100 on either side of the handle 86. A plurality of short tabs 102 and long tabs 104 protrude into each opening 100. As shown in FIG. 3D, the interior surface of the middle section 20 includes a pair of bosses 106, 108 circumferentially spaced from each opening 100. One boss 106 is aligned with the recess (FIG. 3A) to form a detent when the latch 80 is in the unlocked position and the other boss 108 is aligned with the recess to form a detent when the latch 80 is in the locked position, as shown in FIG. 4.

Figure 4:
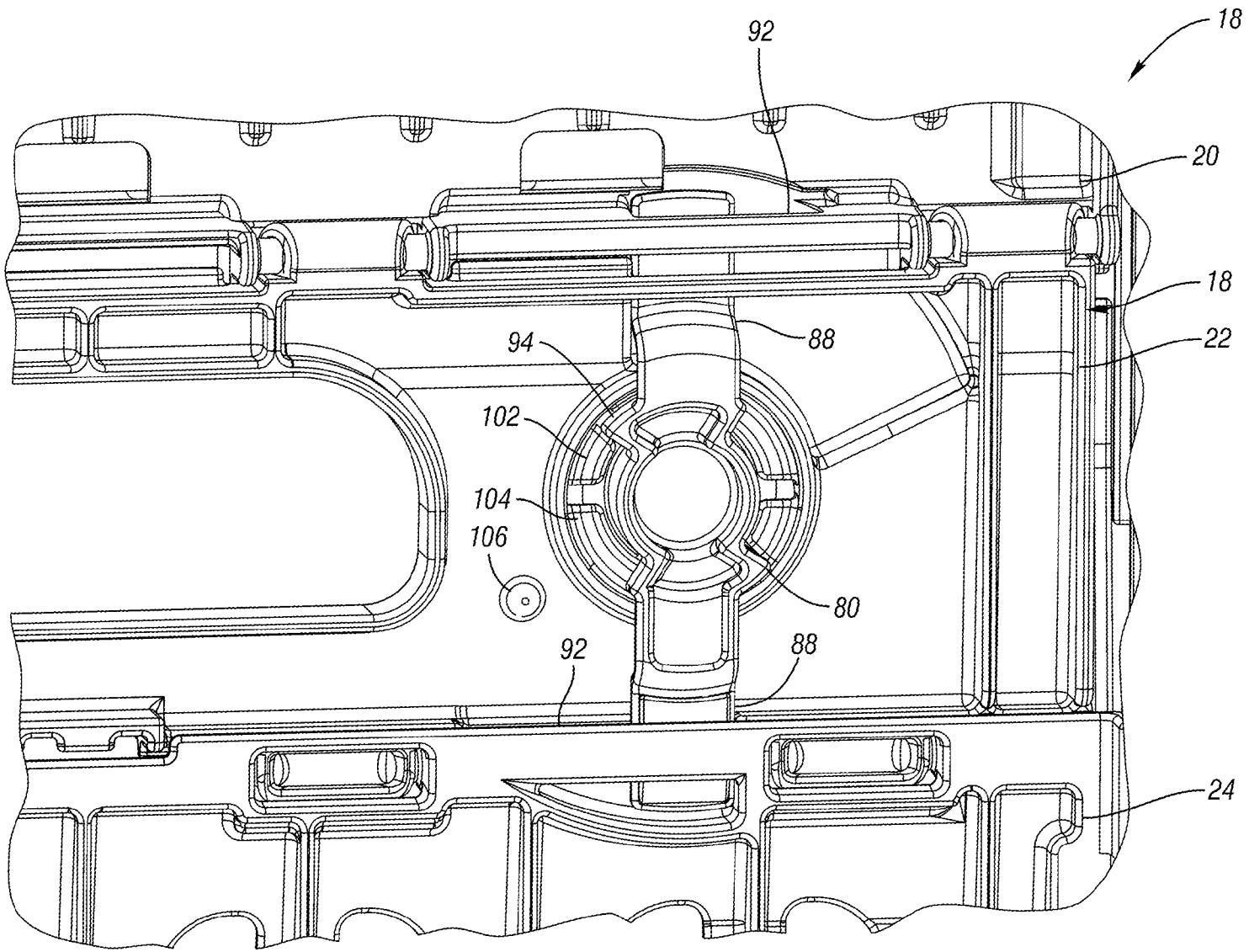
FIG. 4 is an enlarged interior view of one of the latches in the front wall of the crate of FIG. 1 in a locked position.

FIG. 4 is an enlarged interior view of one of the latches 80 in the locked position with the fingers 88 received in the slots 90, 92.

Figure 5:
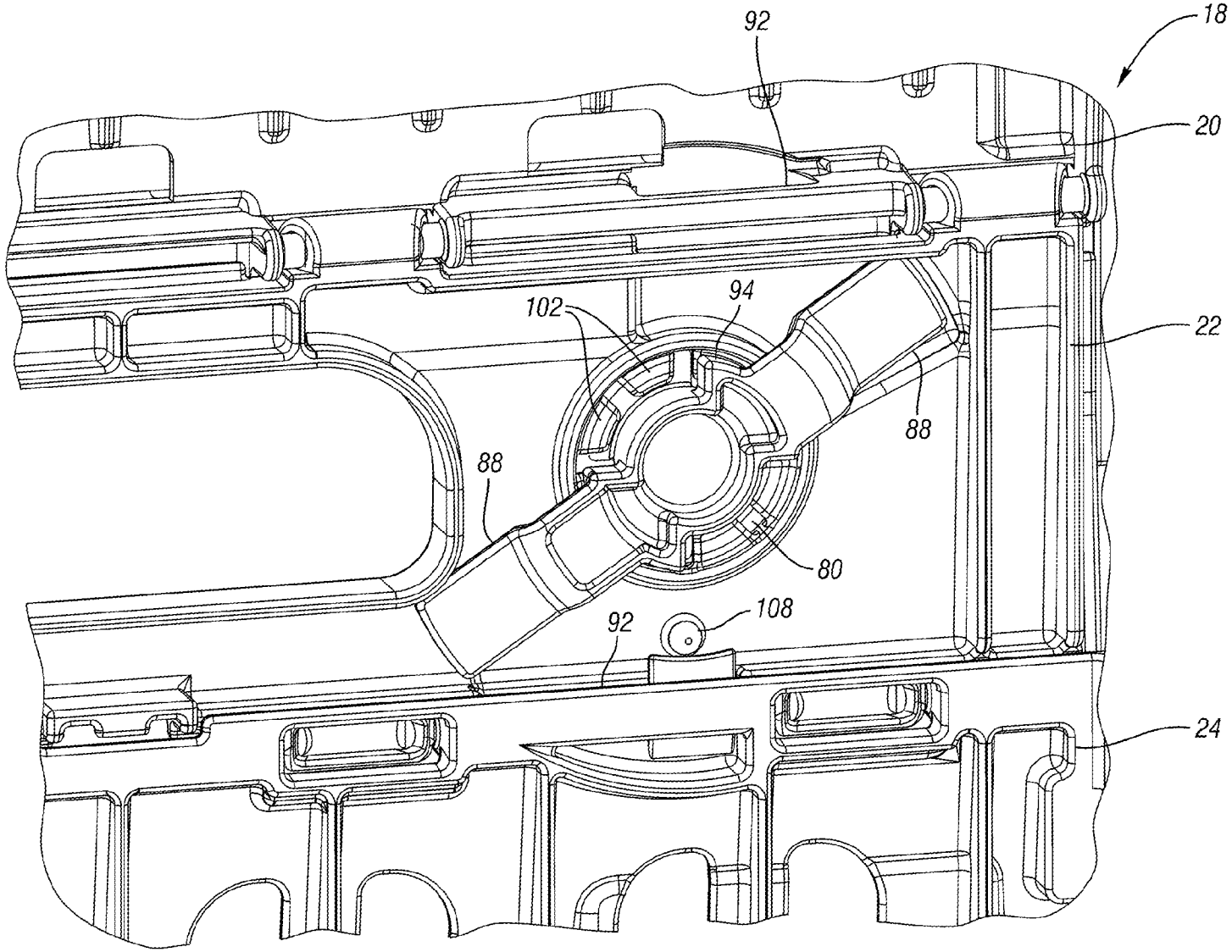
FIG. 5 illustrates the latch of FIG. 4 in an unlocked position.
Figure 6:
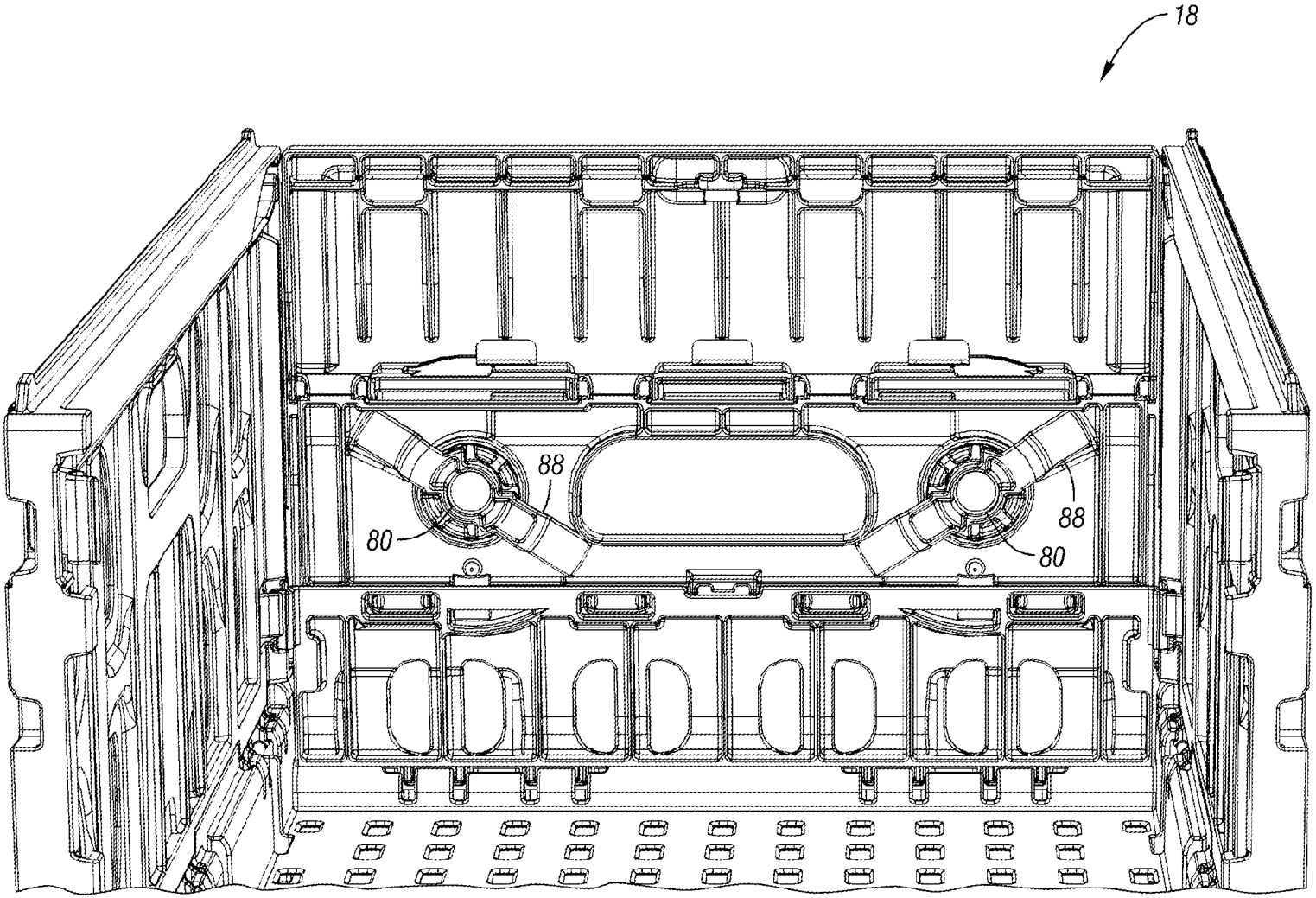
FIG. 6 is an interior view of the front wall of the crate of FIG. 1 with the latches unlocked so that the front wall can be retracted.
Figure 7:
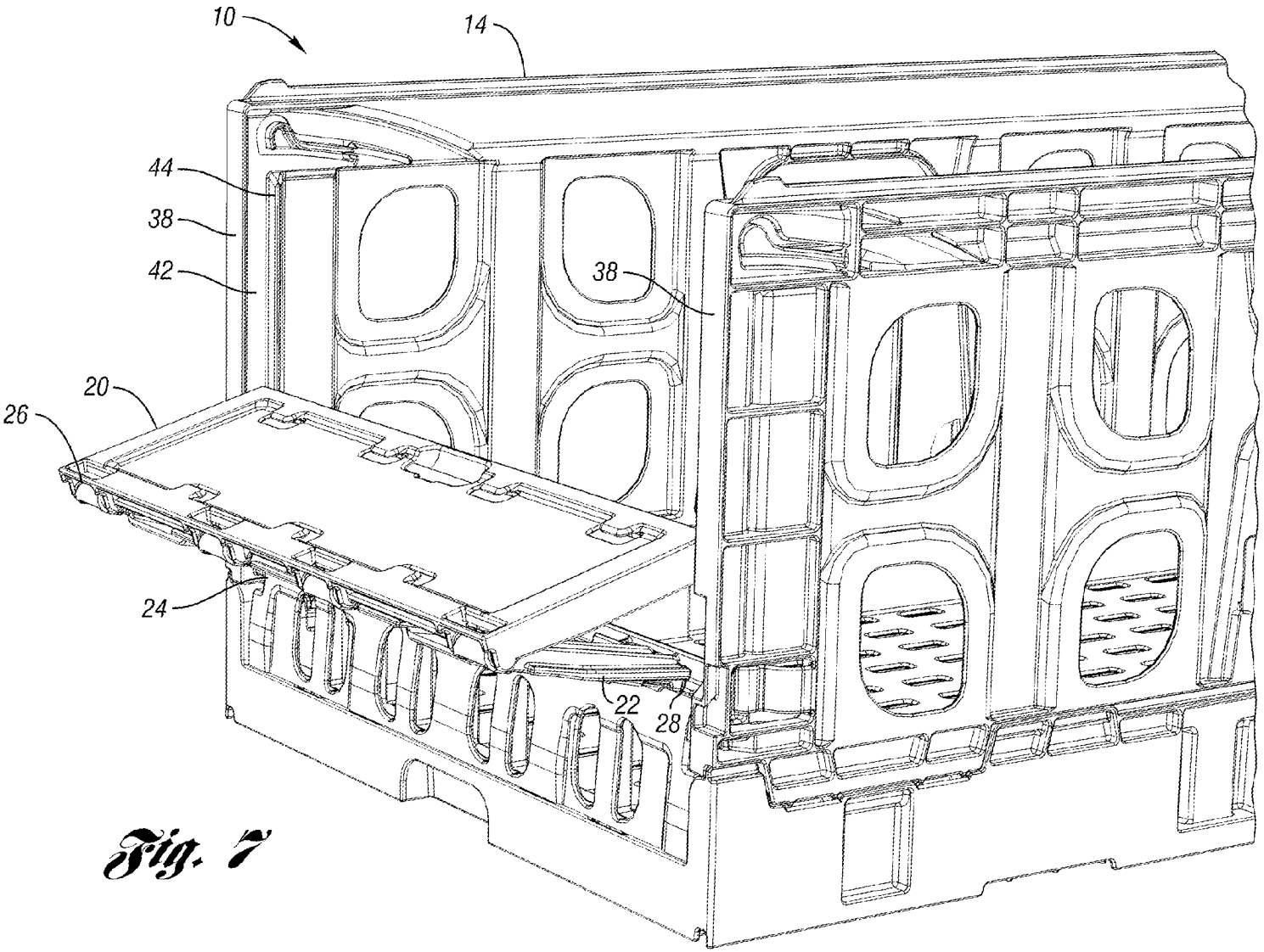
FIG. 7 illustrates a second step in retracting the front wall of the crate of FIG. 1.
Figure 8:
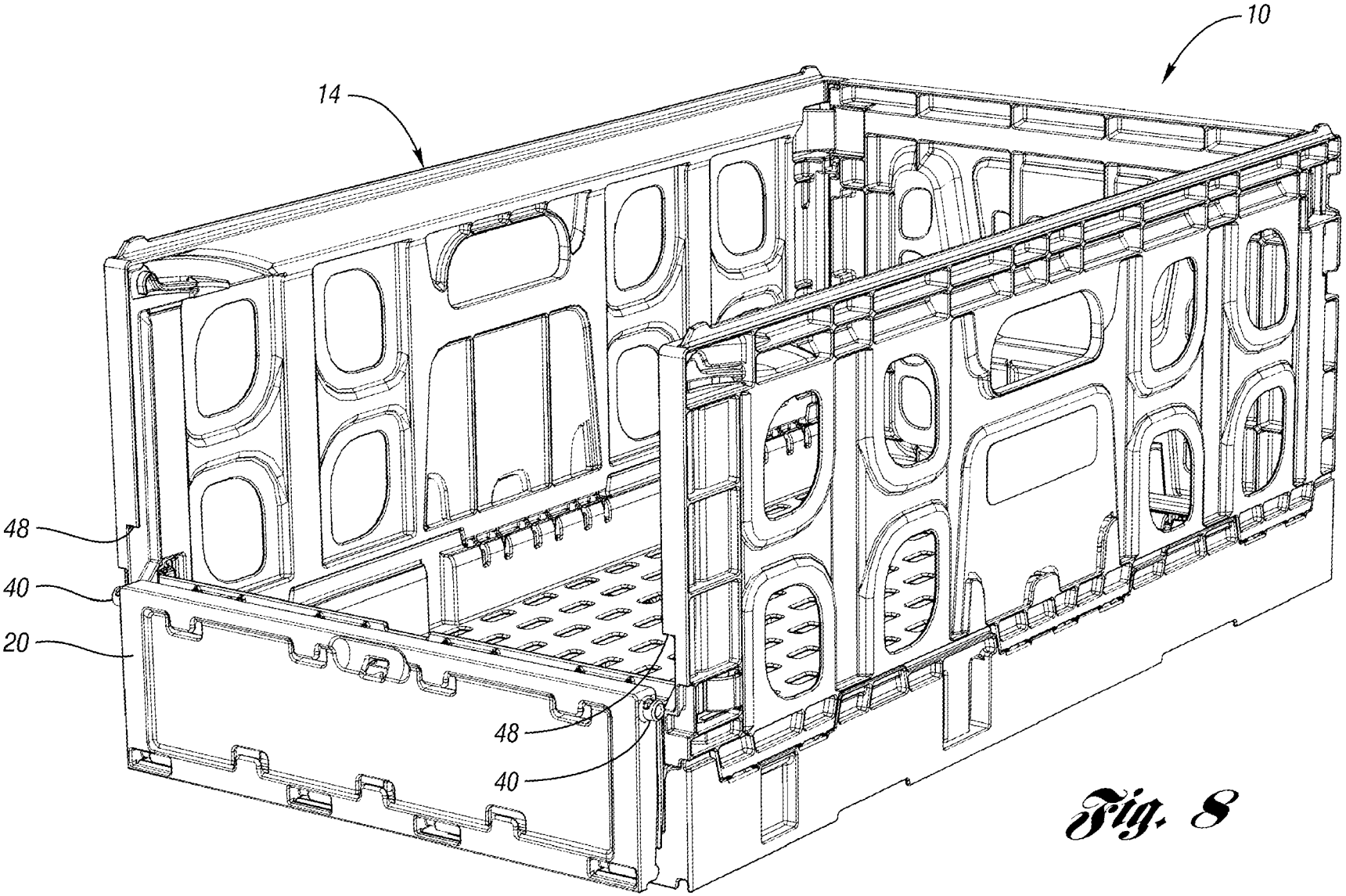
FIG. 8 illustrates the crate of FIG. 1 with the front wall in a retracted position.

FIG. 5 illustrates the latch 80 rotated to an unlocked position, such that the fingers 88 are not received in the slots 90, 92. FIG. 6 illustrates both latches 80 unlocked so that the front wall 18 can be retracted. With the latches 80 unlocked, the middle section 22 can pivot relative to the upper section 20 and lower section 24 on hinges 26, 28 as shown in FIG. 7. The top of the middle section 22 pivots outwardly and the lateral protrusions 40 of the upper section 20 slide downwardly within the channels 42 in the side walls 14 until the lateral protrusions 40 can be removed from the channels 42 via the openings 48, as shown in FIG. 8. The middle section 22 and upper section 20 are then positioned in front of the lower section 24 when the front wall 18 is in the retracted position as shown in FIG. 8.

Figure 9:
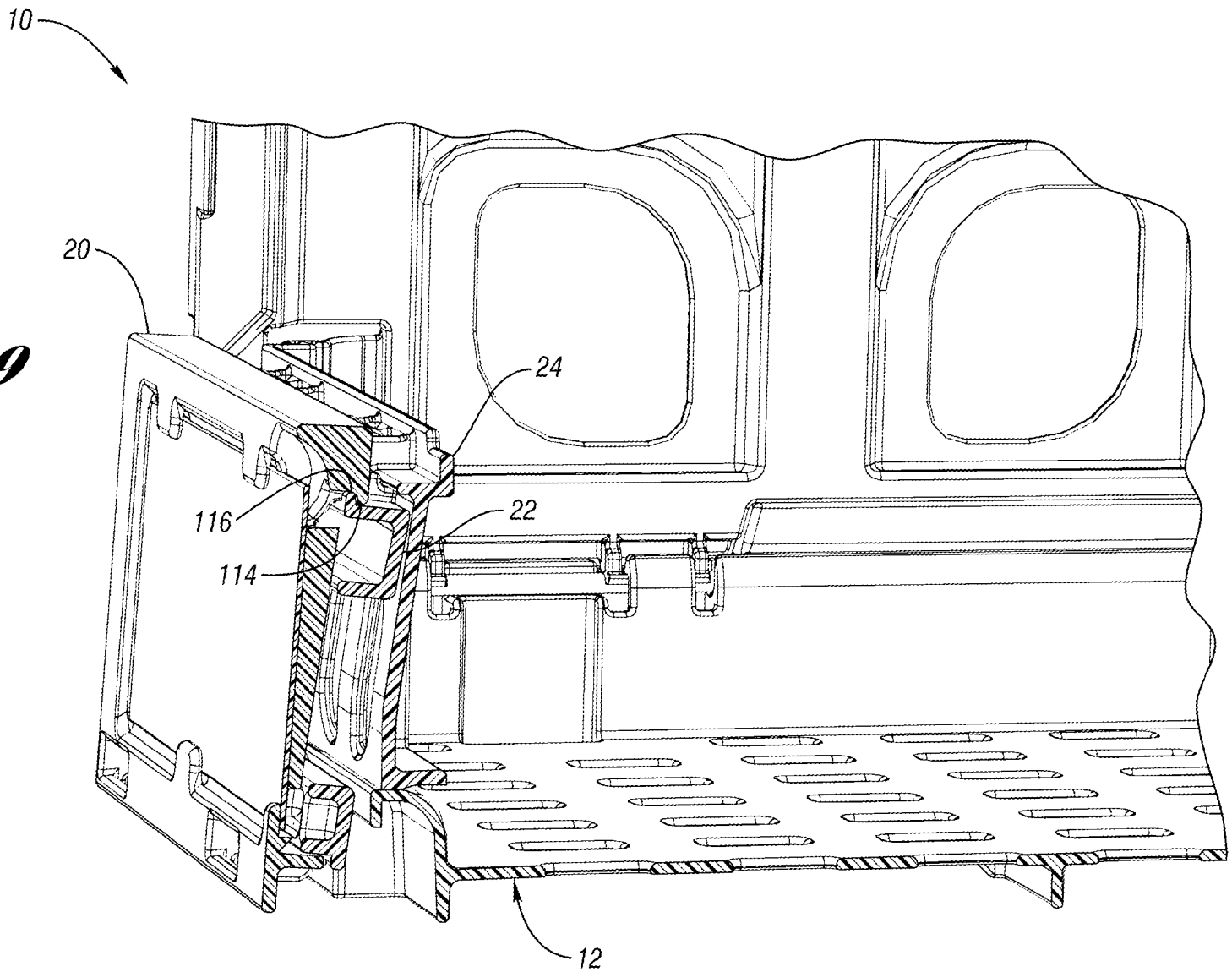
FIG. 9 is a section view through the retracted front wall of FIG. 8.

FIG. 9 is a section view through the retracted front wall 18 of FIG. 8. In the retracted position, the upper section 20 is in contact with the middle section 22. A lip 114 snaps past a lip 116 on the middle section 22 to retain the upper section 20 in place in the retracted position.

Figure 10:
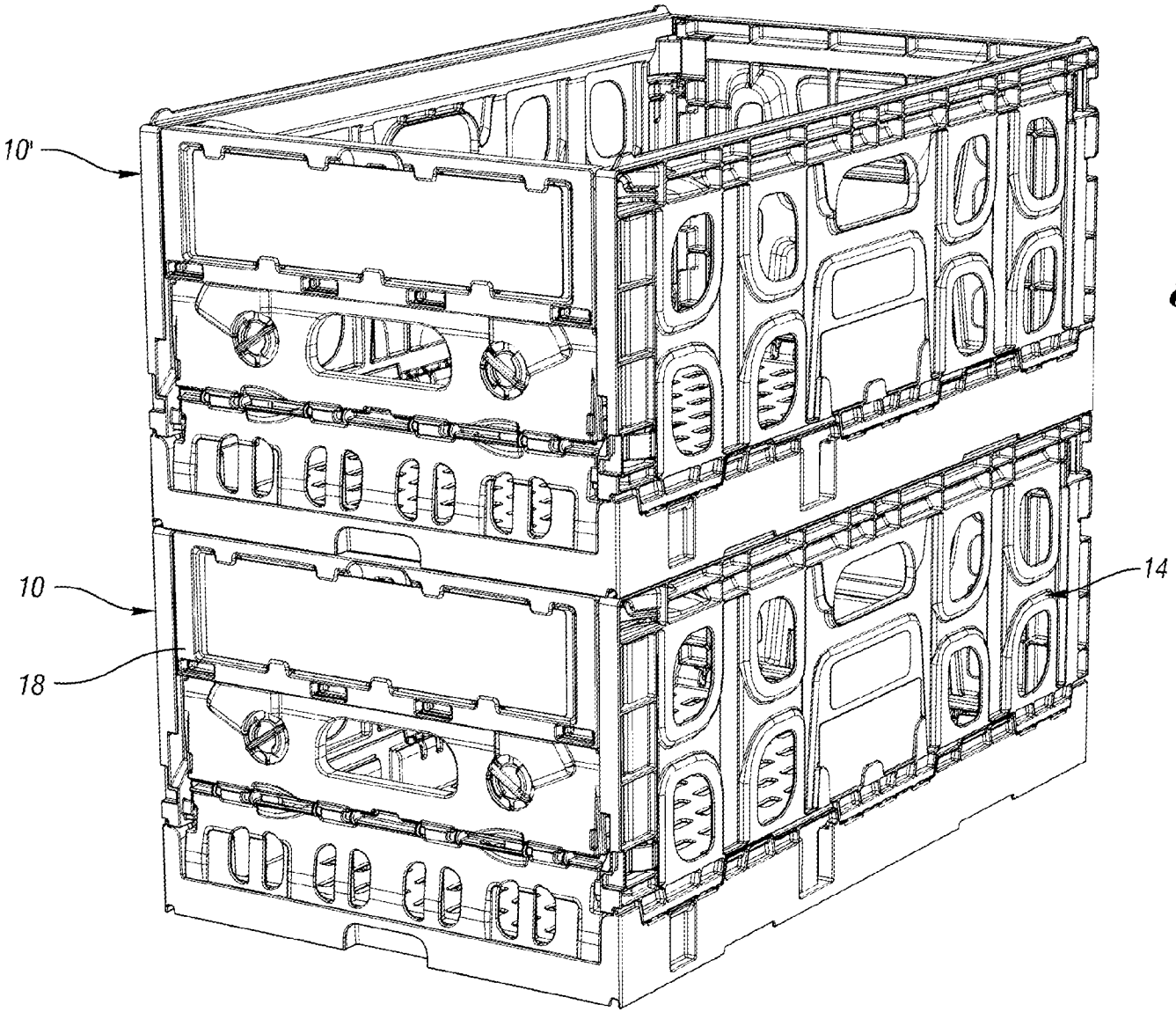
FIG. 10 is a perspective view of the crate of FIG. 1 with another crate stacked thereon.

FIG. 10 is a perspective view of the crate 10 with another crate 10' stacked thereon. It should be appreciated that the front wall 18 of the lower crate 10 could be retracted according to FIGS. 5-8 while the upper crate 10' is supported thereon.

Figure 11:
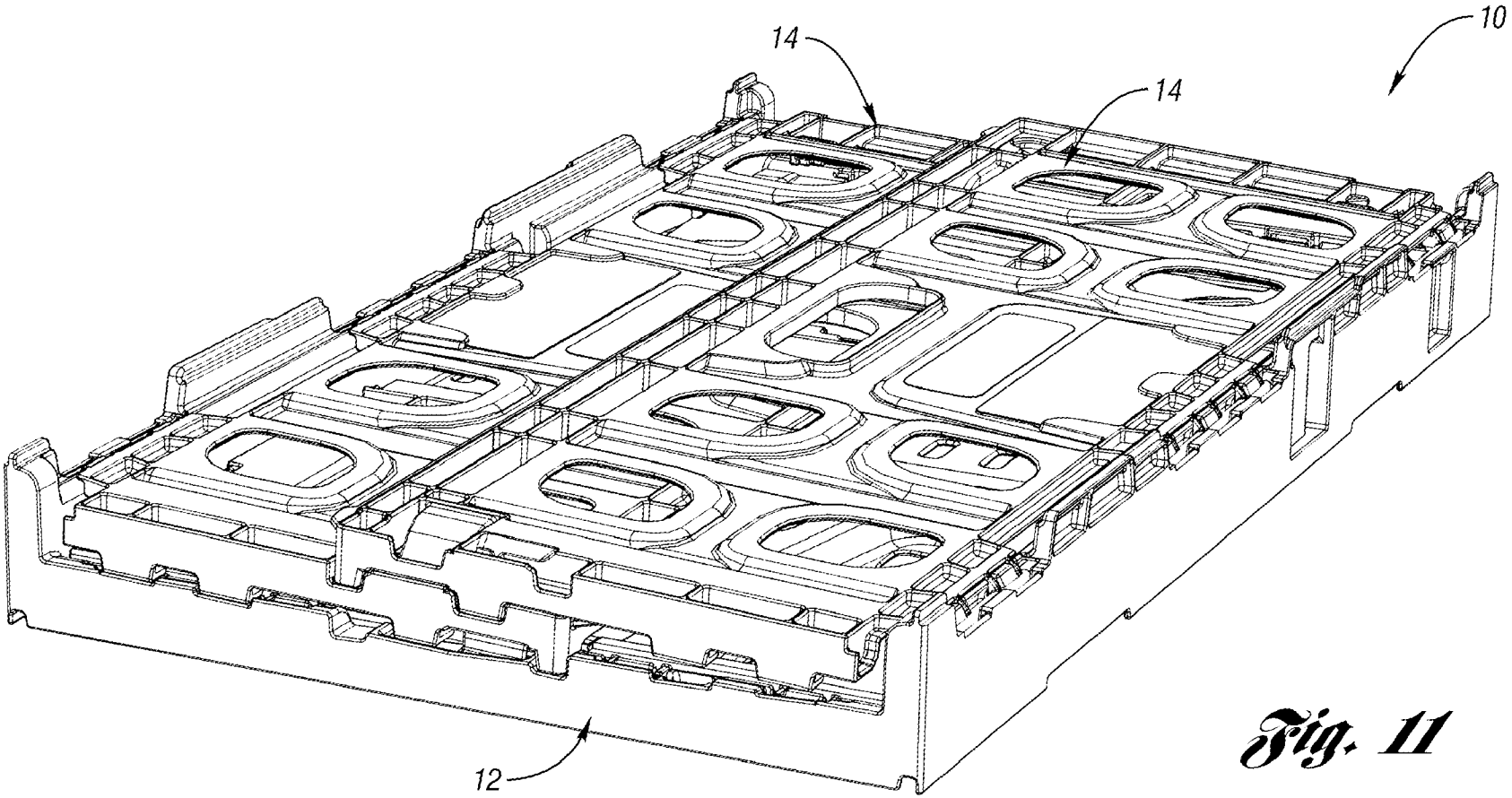
FIG. 11 illustrates the crate of FIG. 1 in a collapsed condition.
Figure 12:
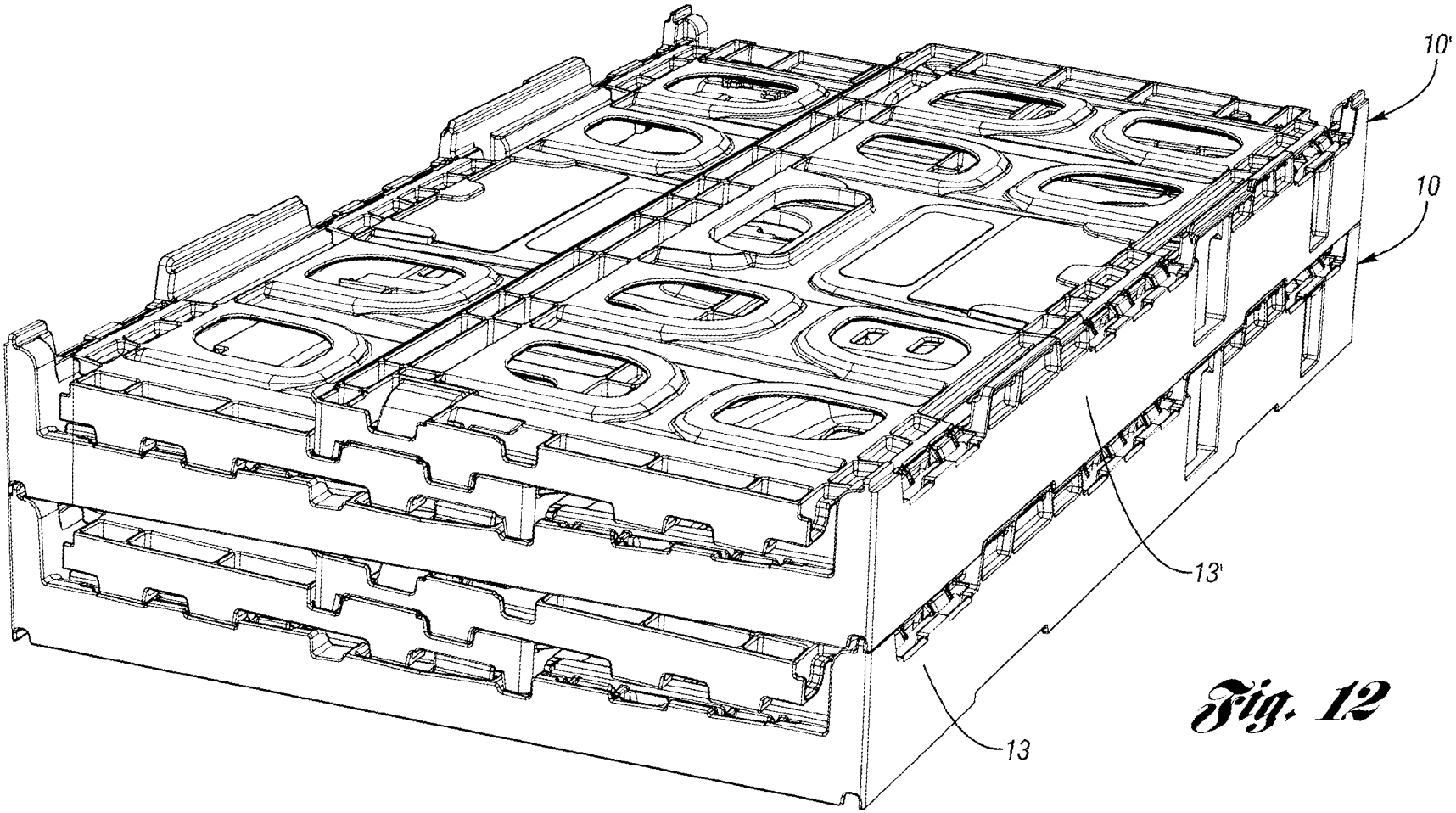
FIG. 12 is illustrates the crate of FIG. 11 with a similar crate stacked thereon.

FIG. 11 illustrates the crate 10 of FIG. 1 in a collapsed condition, with the front and rear walls 18, 20 collapsed onto the base 12 and the side walls 14 collapsed onto the base 12 on top of the front and rear walls 18, 20. A similar collapsed crate 10' having integrally molded upstanding portions 13' can be stacked on the collapsed crate 10, as shown in FIG. 12.

In use, egg cartons (or other items) would be shipped to a store in the crate 10 with the front wall 18 closed (FIG. 1). At the store, the front wall 18 would be collapsed (FIGS. 5-8) to provide access to the egg cartons in the interior of the crate 10 by customers or by store workers. When empty, the side walls 14 and rear wall 16 are collapsed onto the base 12 as shown in FIG. 10 so that the crates 10 occupy less volume and can be efficiently returned to be reused in shipping additional egg cartons (or other items).

Figure 13:
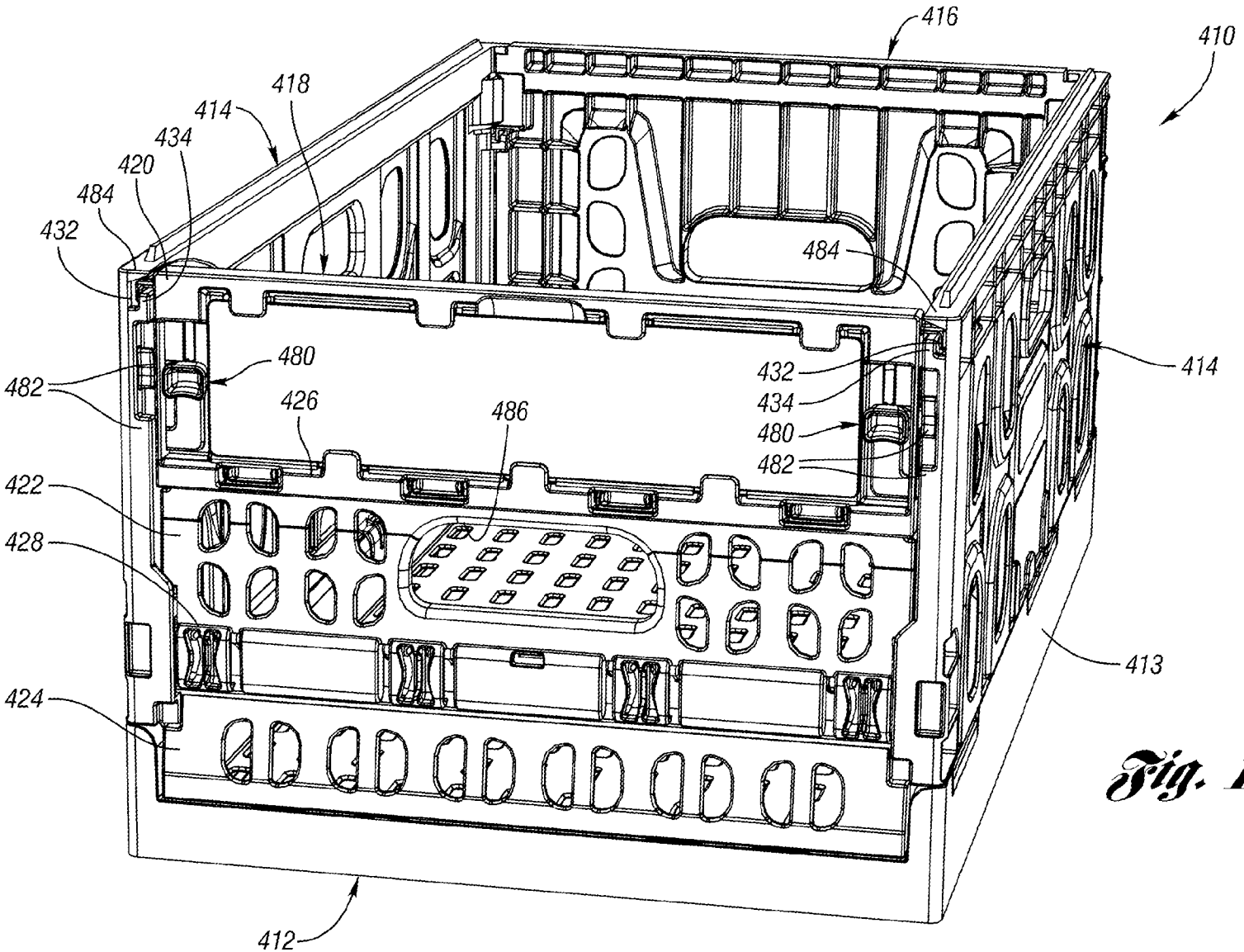
FIG. 13 is a front perspective view of a crate according to a second embodiment of the present invention.

FIG. 13 is a front perspective view of a crate 410 according to a second embodiment of the present invention. The crate 410 includes a base 412 having integrally molded upstanding portions 413 to which are hingably connected side walls 414. A rear wall 416 is also hingably connected to the base 412 and latched to the side walls 414. The front wall 418 includes an upper section 420, a middle section 422 and a lower section 424. The upper section 420 is connected to the middle section 422 by a hinge 426. The middle section 422 is connected to the lower section 424 by a hinge 428.

The front wall 418 is hooked to the side wall 414 in several locations. The upper section 420 includes a pair of hooks or downwardly extending tabs 432 that interlock with rails 434 on the side wall 414. The upper section 420 also includes a pair of latches 480 for selectively locking behind projections 482 of the side walls 414 to prevent the upper section 420 from moving outwardly. An upper wall 484 of each side wall 414 extends over the upper section 420 to prevent the upper section 420 (and the entire front wall 418) from moving upwardly relative to the side walls 414.

A handle opening 486 is formed through the middle section 422. It should be noted that the crate 410 can be lifted using handle opening 486 without releasing the front wall 418, because the front wall 418 will contact the upper walls 484 of the side walls 414.

Figure 14:
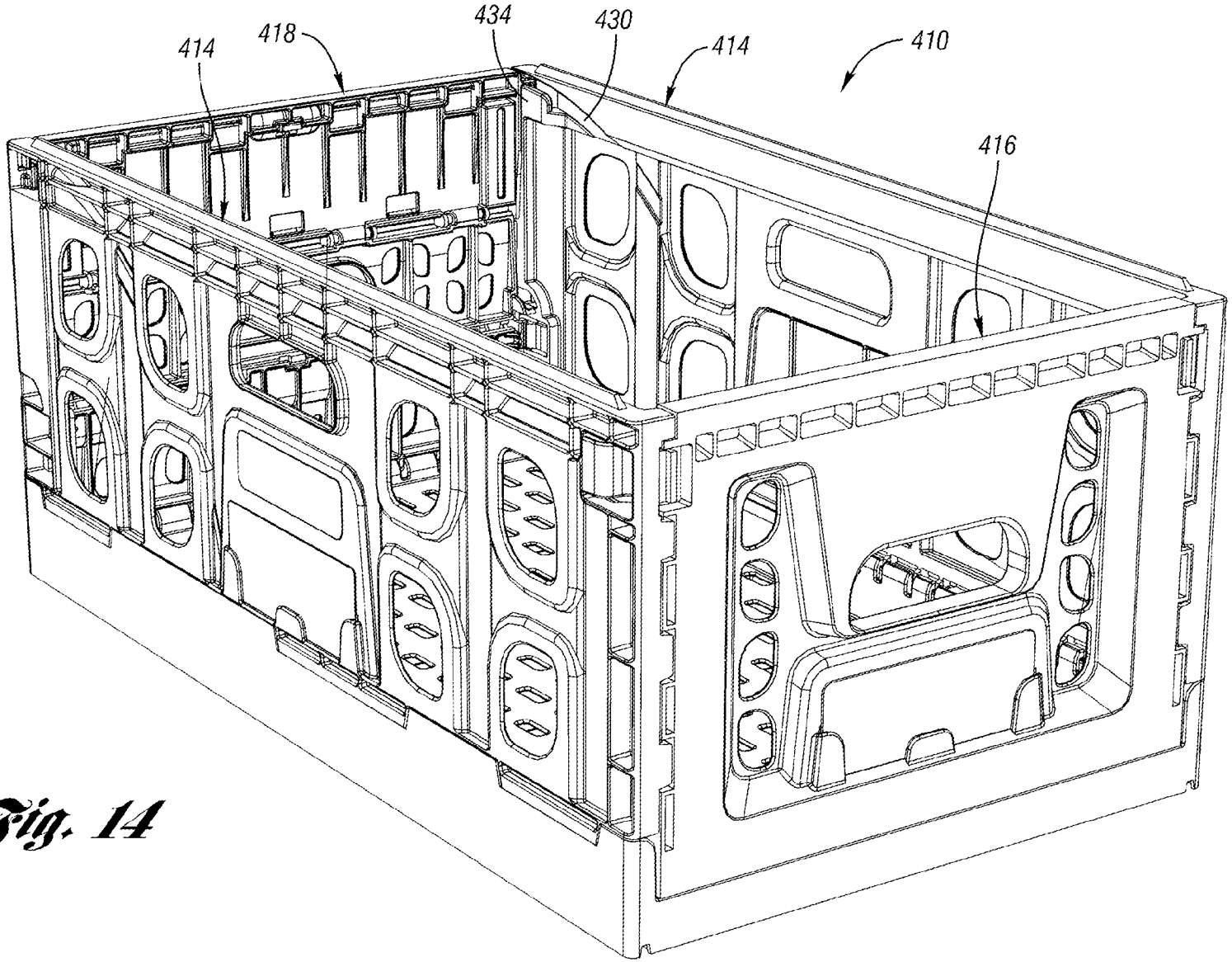
FIG. 14 is a rear perspective view of the crate of FIG. 13.

FIG. 14 is a rear perspective view of the crate 410. The interior of the side walls 414 each include a curved channel 430 extending from an upper portion of the upper section 420 down to the base 412 in an arcuate path.

Figure 15:
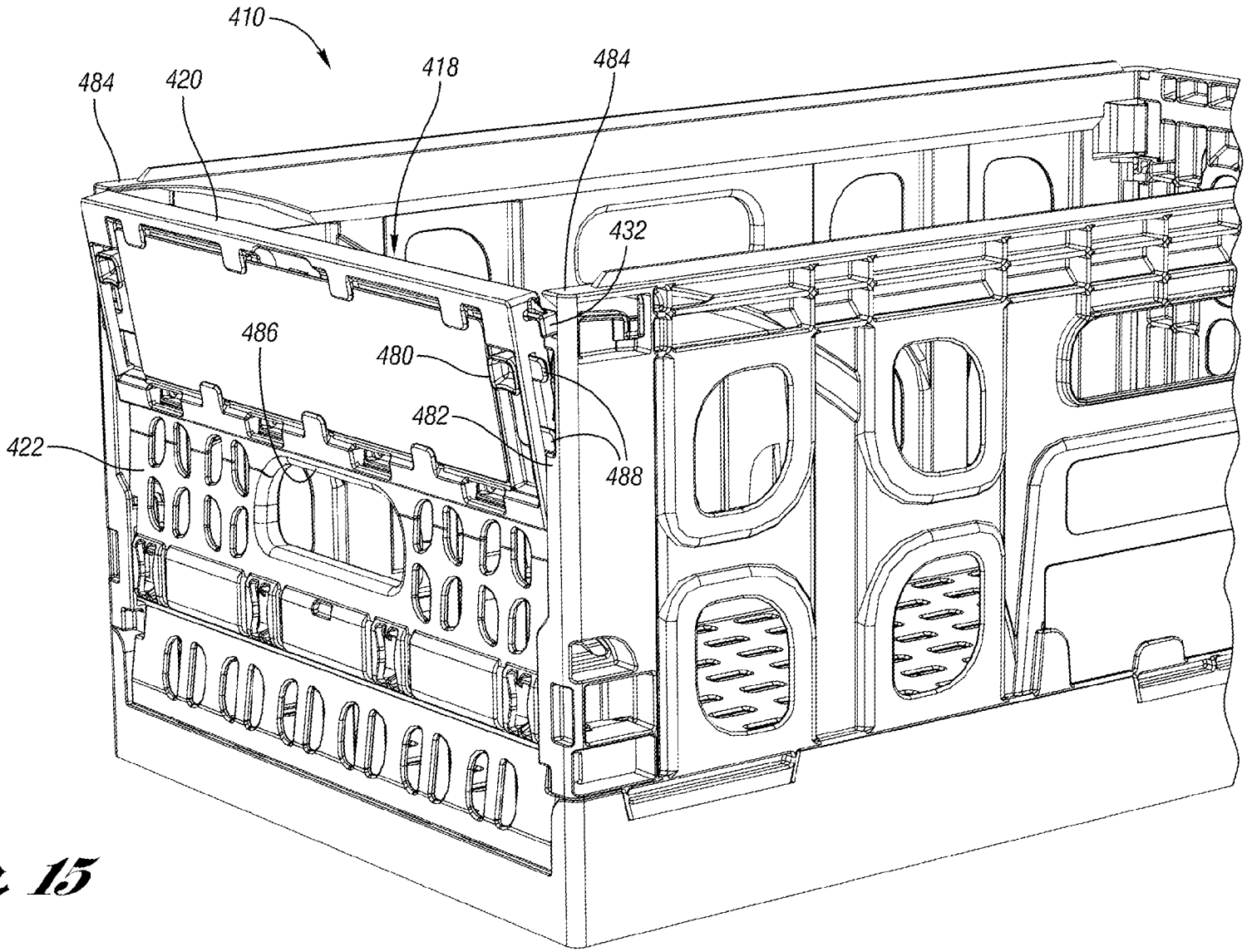
FIG. 15 shows the upper section of the front wall slightly removed from the front opening.
Figure 16:
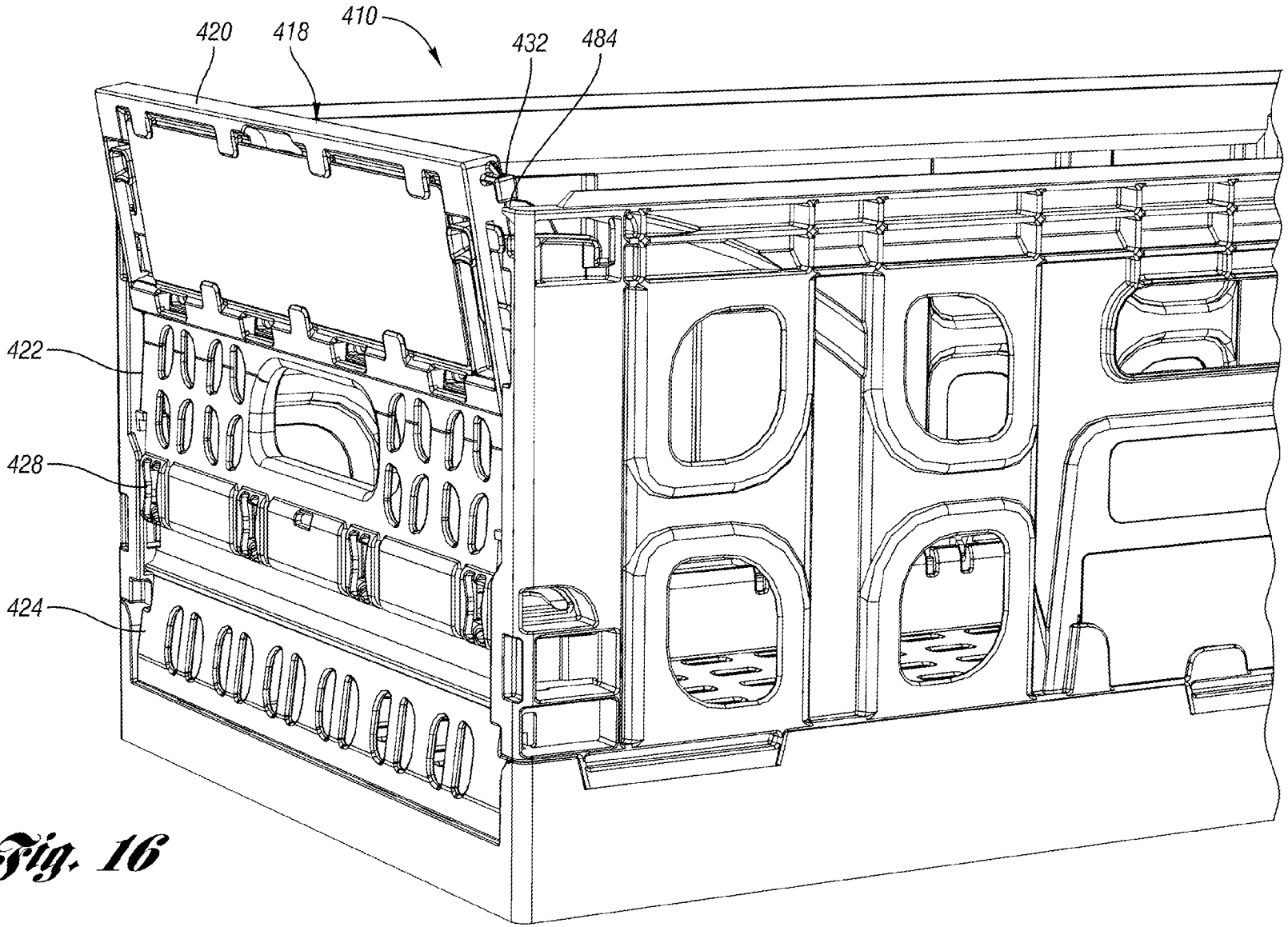
FIG. 16 shows the upper section and middle section lifted relative to the lower section and side walls.
Figure 17:
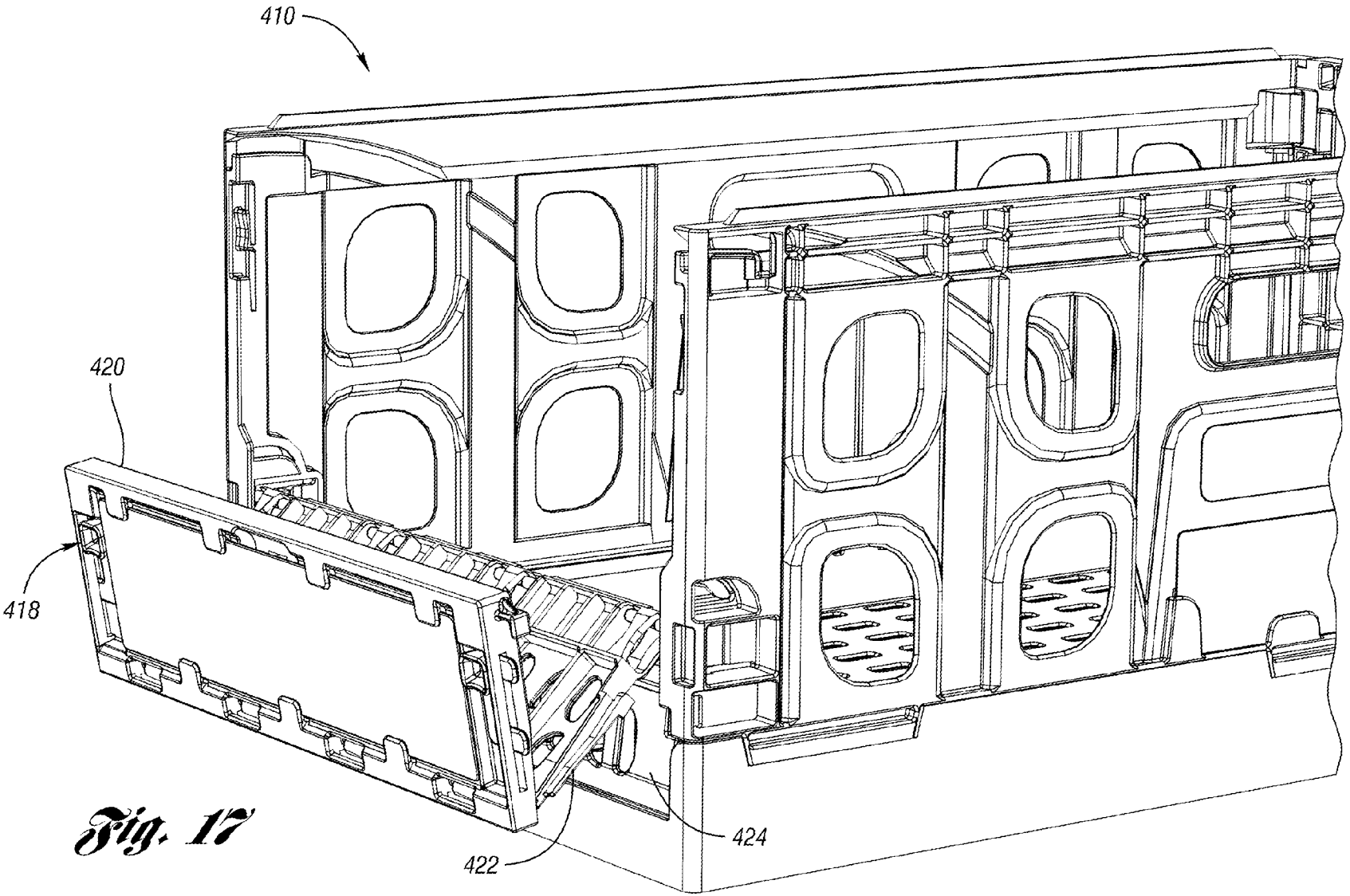
FIG. 17 shows the upper section and middle section moving toward the retracted position.
Figure 18:
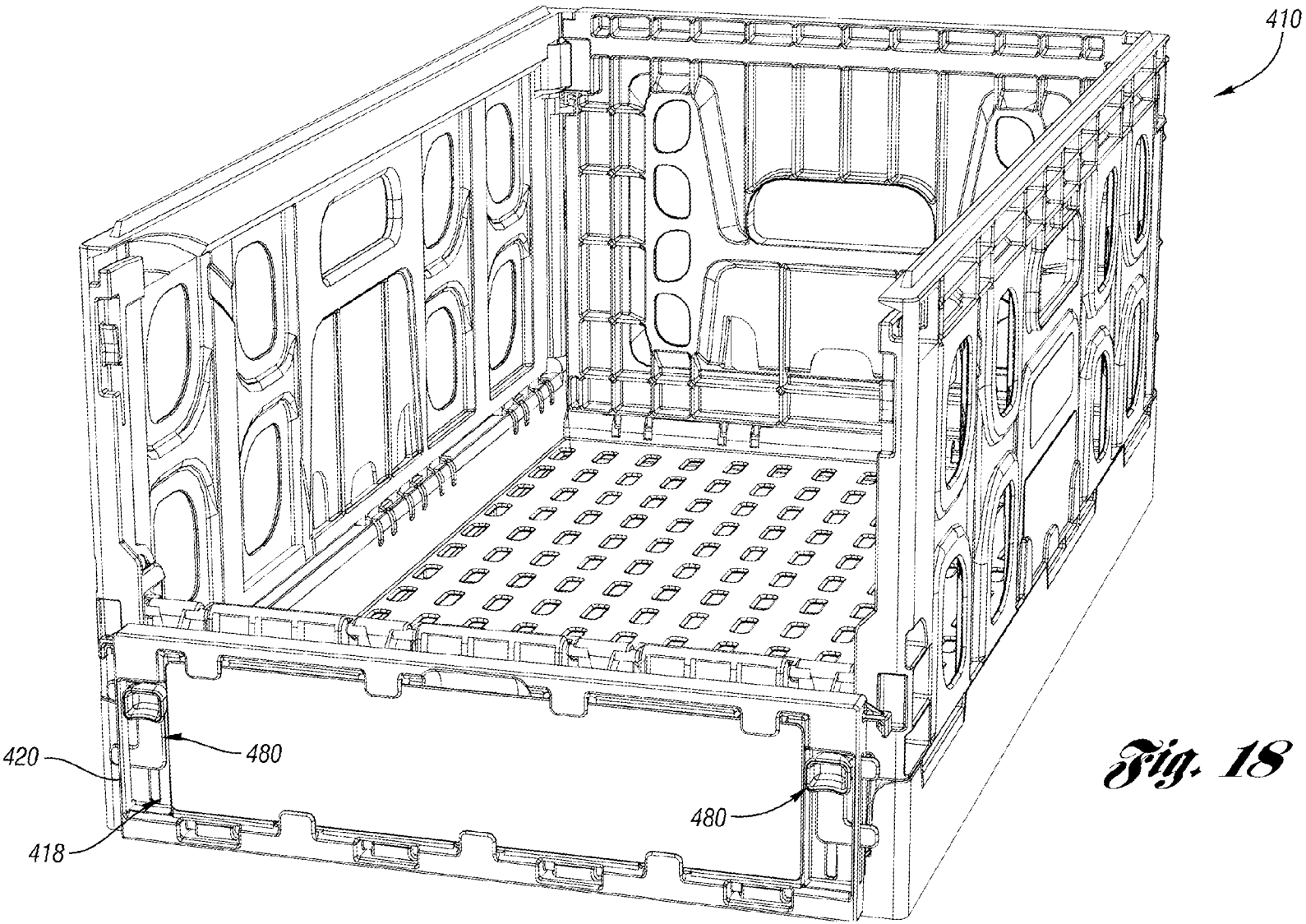
FIG. 18 shows the front wall in the retracted position.

FIG. 15 shows the upper section 420 slightly removed from the side walls 414. Each latch 480 includes a pair of laterally-projecting, vertically-spaced tabs 488 that are slidable behind the projections 482 of the side walls 414, as in FIG. 13. In FIG. 13, the latches 480 are in a lower, latched position with the tabs 488 locked behind the projections 482. In FIG. 15, the latches 480 are in an upper, unlatched position with the tabs 488 above the projections 482, so that the upper panel 420 can be tilted outwardly as shown in FIG. 15. This moves the upper edge of the upper section 420 out from under the upper walls 484 of the side walls 414, so that the upper section 420 (and with it, the middle section 422) can be lifted relative to the side walls 414 and the lower section 424 (via translating hinge 428) as shown in FIG. 16. The front wall 418 can then be collapsed as shown in FIGS. 17-18.

Figure 19:
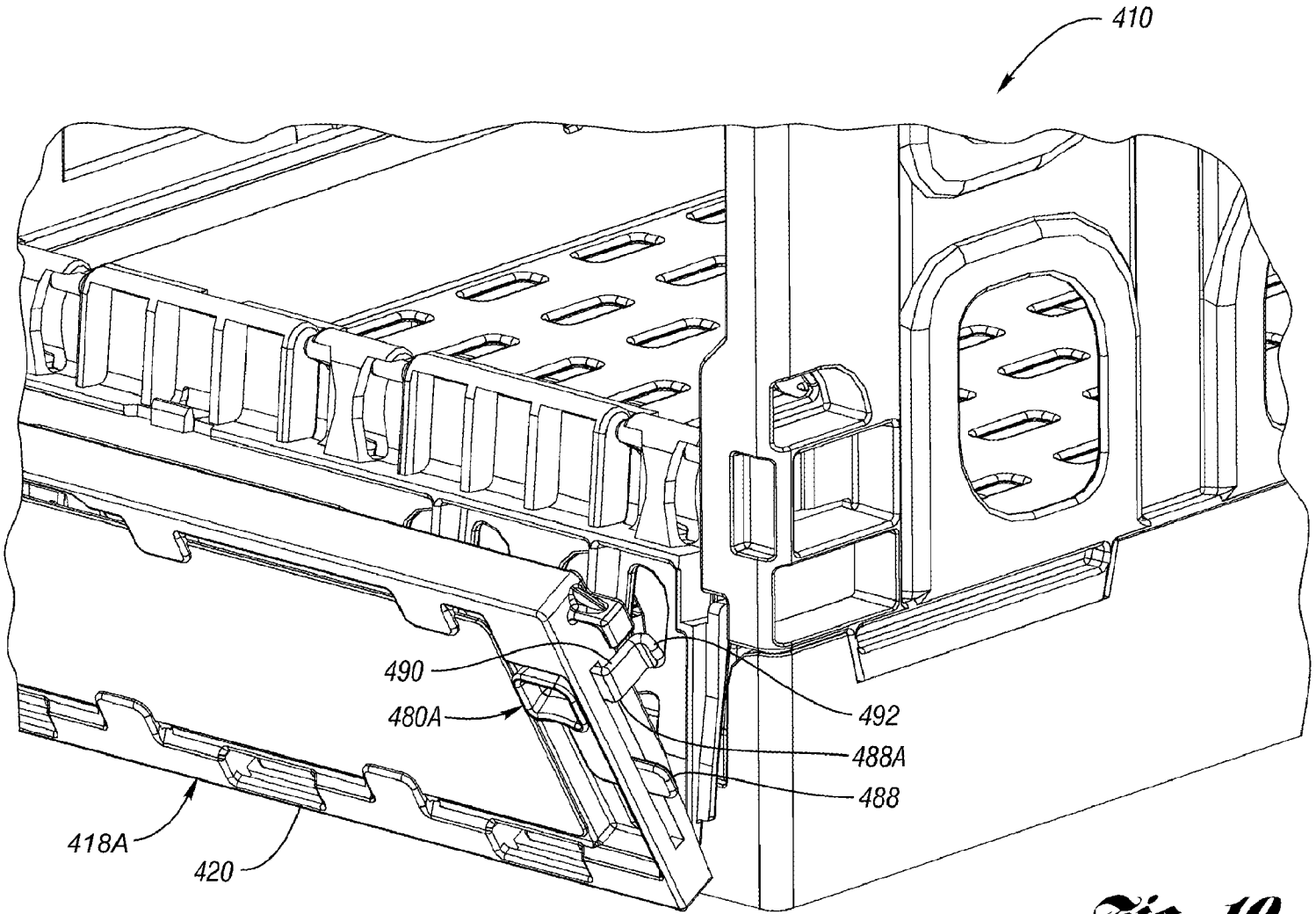
FIG. 19 shows an optional front wall for the container of FIG. 13.
Figure 20:
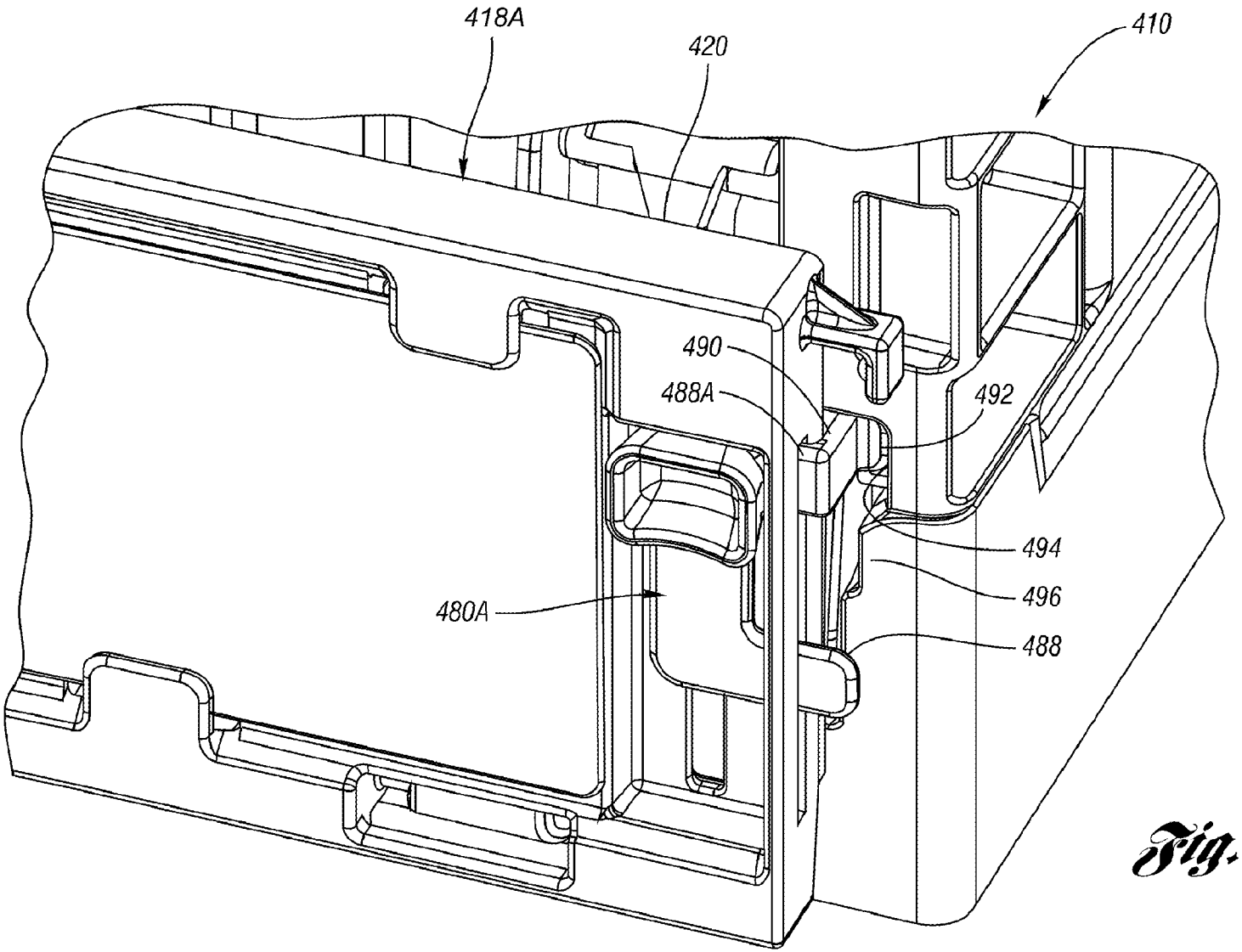
FIG. 20 shows the optional front wall of FIG. 19 in a second position.
Figure 21:
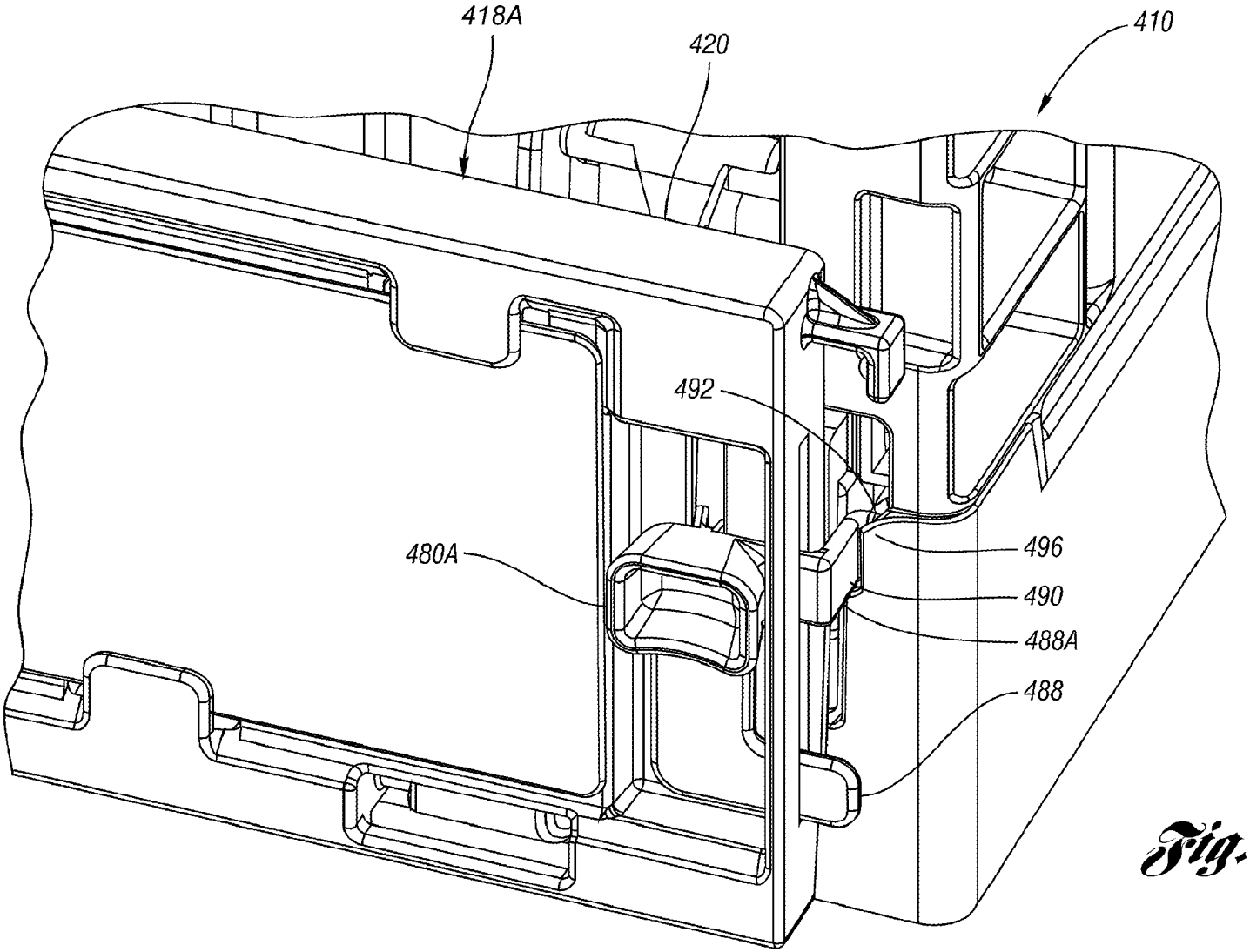
FIG. 21 shows the optional front wall of FIG. 19 in a retracted position.

FIGS. 19-21 illustrate an optional front wall 418A for the crate 410. At least one of the tabs 488A of each of the latches 480A (only one illustrated) includes a rearward arm 490 and a lateral projection 492, as shown in FIG. 19. When the upper section 420 and middle section 422 (not visible in FIG. 20) is moved against the crate 410, the rearward arm 490 and lateral projection 492 of the latch 480A extend into a recess 494 formed in the side wall 414 above a flange 496. When the latch 480A is then moved downwardly, as shown in FIG. 21, the lateral projection 492 interlocks behind the flange 496. In this manner, the folded front wall 418 is retained in place against the crate 410.

Figure 22:
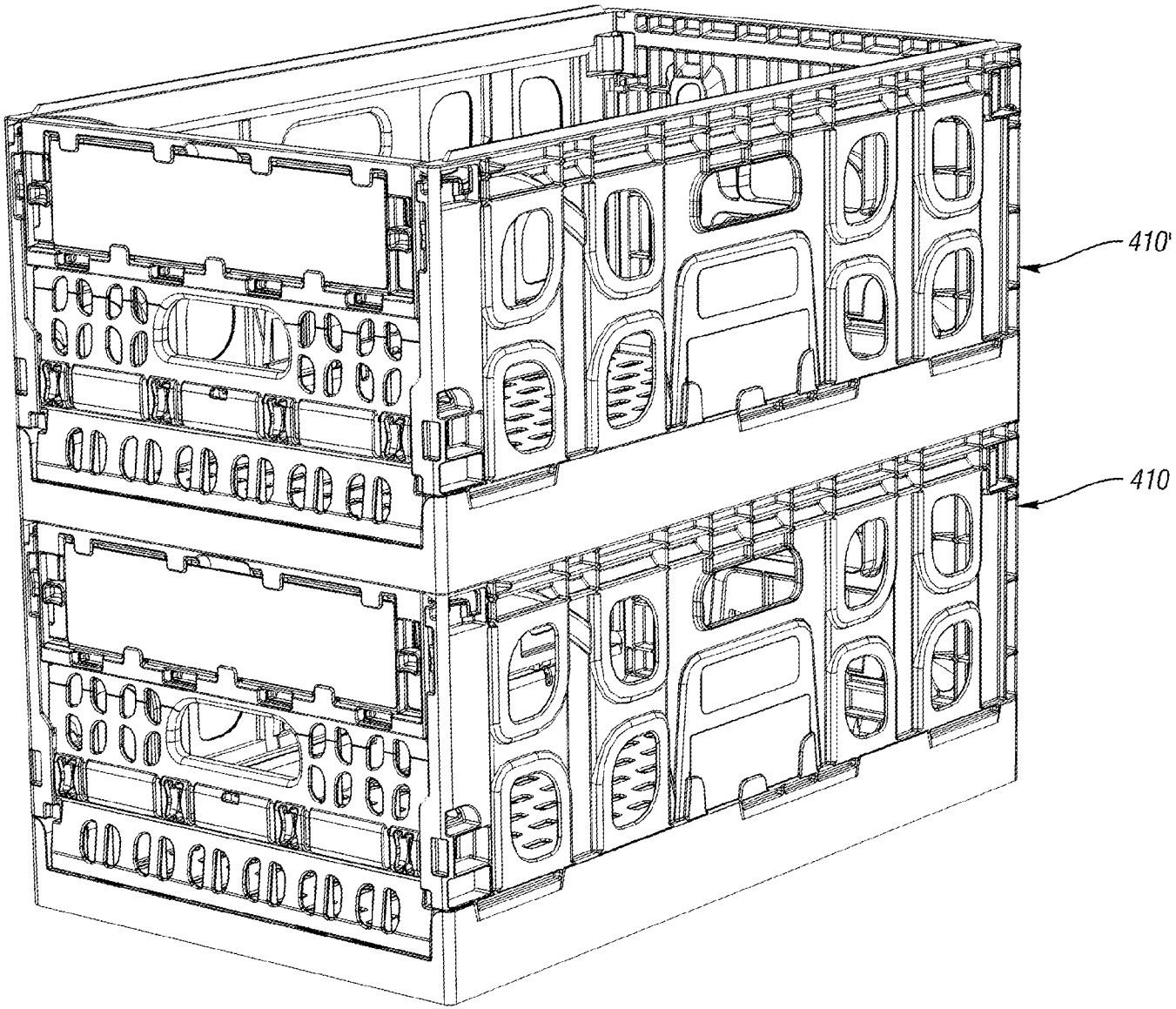
FIG. 22 is a perspective view of the container of FIG. 13 with a similar container stacked thereon.
Figure 23:
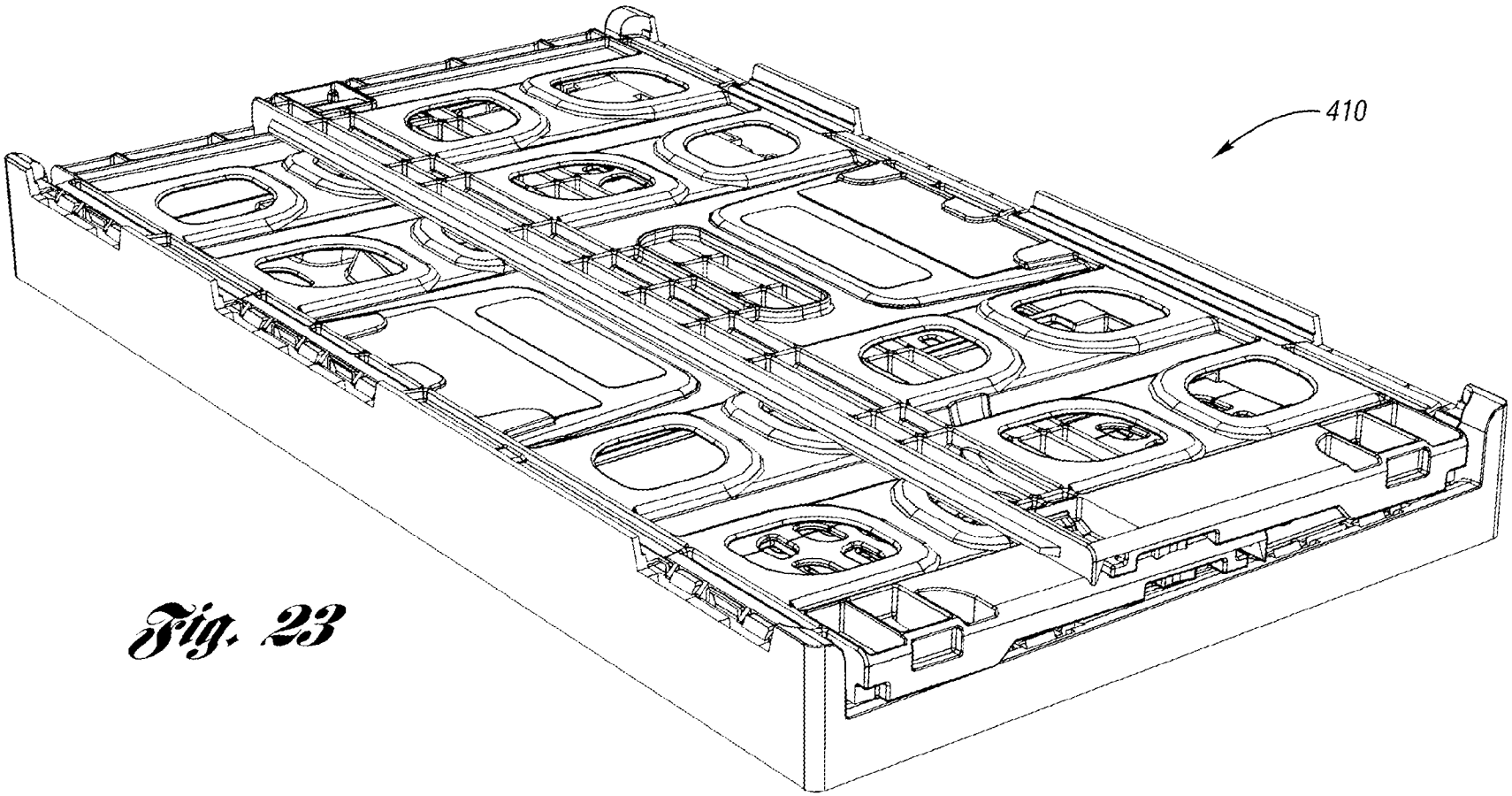
FIG. 23 is a perspective view of the container of FIG. 13 in a collapsed position.

In use, egg cartons (or other items) would be shipped to a store in the crate 410 with the front wall 418 closed (FIG. 13). In this embodiment, the crate 410 can be carried using the handle 486 in the front wall 418. The crate 410 supports a similar crate 410' stacked thereon, as shown in FIG. 22, and could also support a similar crate 410' stacked thereon with the front wall 418 open. At the store, the front wall 418 would be retracted (FIG. 18 or 21) to provide access to the egg cartons in the interior of the crate 410 by customers or by store workers. When empty, the side walls 414 and rear wall 416 are collapsed onto the base 412 as shown in FIG. 23 so that the crates 410 occupy less volume and can be efficiently returned to be reused in shipping additional egg cartons (or other items).

It should be noted that the front wall in any embodiment is only designated "front" for convenience of reference, and that by itself, the term "front" does not require any specific wall (or walls) of the container to have these features. In the particular application of shipping egg cartons, it is expected that the retractable wall would be oriented toward the customers; however this invention is not limited to that application or to only the "front" wall being retractable. Unless otherwise required by the claims, the long walls could be retractable.

Further, the retractable wall could also be provided in a nestable container in which the other walls do not collapse onto the base. The other walls may be integrally molded with the base.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed:

1. A container comprising:

a base;

a plurality of side walls extending upward from the base, the plurality of side walls including a first wall, the first wall including a plurality of pivotably connected sections retractable to provide an opening into the container and movable to an extended upright position at least partially closing the opening into the container; and at least one latch selectively movable relative to at least one of the plurality of sections to selectively prevent retraction of the sections, wherein the at least one latch selectively connects one of the plurality of sections to another of the plurality of sections.

2. The container of claim 1 wherein two of the plurality of sections are pivotable and slidable relative to one another.

3. The container of claim 2 wherein a third section of the plurality of sections includes the at least one latch.

4. The container of claim 1 wherein the at least one latch is rotatable between a latched position and an unlatched position, wherein the sections are prevented from being retracted by the at least one latch being in the latched position.

5. The container of claim 4 wherein the plurality of sections includes a middle section, an upper section and a lower section, and wherein the at least one latch is rotatably mounted to the middle section, such that the at least one latch secures the middle section to the upper section and to the lower section when the at least one latch is in the latched position.

6. A container comprising:

a base;

a plurality of side walls extending upward from the base, the plurality of side walls including a first wall, the first wall including a plurality of pivotably connected sections retractable to provide an opening into the container and movable to an extended upright position at least partially closing the opening into the container; and at least one latch selectively movable relative to at least one of the plurality of sections to selectively prevent retraction of the sections, wherein the at least one latch is rotatable between a latched position and an unlatched position, wherein the sections are prevented from being retracted by the at least one latch being in the latched position and wherein rotation of the latch to the unlatched position permits the sections to be retracted.

7. The container of claim 1 wherein the at least one latch selectively connects one of the plurality of sections to another of the plurality of side walls other than the first wall.

8. The container of claim 7 wherein the at least one latch is slidable between a latched position and an unlatched position, wherein the sections are prevented from being retracted by the at least one latch being in the latched position.

9. The container of claim 1 wherein the plurality of side walls are movable between an upright position and a collapsed position generally parallel to the base.

10. The container of claim 1 wherein the plurality of pivotably connected sections are retractable into a retracted position and the plurality of sections substantially overlap one another in the retracted position and wherein the plurality of sections overlap one another more in the retracted position than in the extended upright position.

11. The container of claim 1 further including at least one detent maintaining the at least one latch in a latched position where the at least one latch prevents retraction of the sections.

12. The container of claim 11 further including at least one detent maintaining the at least one latch in an unlatched position where the at least one latch permits retraction of the sections.

13. The container of claim 1 wherein the plurality of sections are retractable to a retracted position when a similar container is stacked on the container.

14. A method of using a container having a plurality of walls, including a first wall, extending upwardly from a base, the method including the steps of:

a) pivoting a first section of the first wall relative to a second section of the first wall from a retracted position wherein the first wall provides an opening into the container to an extended upright position further closing the opening into the container;

b) moving at least one latch relative to at least one of the first and second sections to selectively prevent retraction of the sections;

c) moving the at least one latch to permit retraction of the sections;

d) after said step c), pivoting the first section away from an interior of the container and away from upper walls of adjacent walls that otherwise prevent lifting the first section relative to the base; and e) after said step d), lifting the first and second sections away from the base, thereby releasing the second section from the adjacent walls to be pivoted toward the retracted position.

* * * * *